US007640622B2

(12) United States Patent
Vankouwenberg

(10) Patent No.: US 7,640,622 B2
(45) Date of Patent: Jan. 5, 2010

(54) FLOOR SURFACE CLEANING AND RESURFACING EQUIPMENT

(76) Inventor: Raymond E. Vankouwenberg, 7 Sunleaf Dr., Penfield, NY (US) 14526

( * ) Notice: Subject to any disclaimer, the term of this patent is extended or adjusted under 35 U.S.C. 154(b) by 738 days.

(21) Appl. No.: 11/111,114

(22) Filed: Apr. 21, 2005

(65) Prior Publication Data

US 2005/0235453 A1 Oct. 27, 2005

Related U.S. Application Data

(60) Provisional application No. 60/564,200, filed on Apr. 21, 2004.

(51) Int. Cl.
*E01H 1/04* (2006.01)

(52) U.S. Cl. ..... 15/340.4; 15/373; 15/385; 15/320; 15/401

(58) Field of Classification Search ..... 15/50.1, 15/49.1, 340.1, 340.2, 340.4, 365, 368, 372, 15/373, 385; *E01H 1/04, 1/08*
See application file for complete search history.

(56) References Cited

U.S. PATENT DOCUMENTS

| | | | | |
|---|---|---|---|---|
| 5,623,743 | A * | 4/1997 | Burgoon et al. | 15/320 |
| 6,105,203 | A * | 8/2000 | Hueppi et al. | 15/320 |
| 6,163,923 | A * | 12/2000 | Hefter | 15/340.4 |
| 6,842,940 | B2 * | 1/2005 | Christopher et al. | 15/320 |
| 2004/0049878 | A1 * | 3/2004 | Thomas et al. | 15/320 |

* cited by examiner

*Primary Examiner*—David A Redding
(74) *Attorney, Agent, or Firm*—Hiscock & Barclay, LLP

(57) ABSTRACT

Floor surface scrubbing and resurfacing equipment including a hydraulic system and adjustable linkages to allow a user to adjust particular features to suit the equipment for different applications.

10 Claims, 22 Drawing Sheets

FLOOR SURFACE CLEANING AND RESURFACING EQUIPMENT

BACKGROUND OF THE INVENTION

Conventional floor surface scrubbing and resurfacing equipment have means to raise and lower the scrubbing/resurfacing mechanisms and the skirt mechanisms. These systems generally have two positions: down to engage the floor surface and up to disengage the floor surface. The downward force on the scrubbing/resurfacing mechanisms and skirt mechanisms is not adjustable. Further, the lateral position of the scrubbing/resurfacing mechanisms and skirt mechanisms is not adjustable in conventional floor surface scrubbing and resurfacing equipment.

SUMMARY

In general, one embodiment the floor surface scrubbing and resurfacing equipment of the present invention includes a hydraulic system and adjustable linkages to allow a user to adjust particular features to suit the equipment for different applications. Adjustable features include hydraulic cylinders that allow adjustments in the downward pressure on the scrubbing/resurfacing mechanisms and on the skirts such that the equipment may be configured for applications such as brushing, grinding, or polishing. Further, the lateral position of the scrubbing/resurfacing mechanisms and the skirts is adjustable such that a user may increase the coverage area or increase the overlap in coverage by the scrubbing/resurfacing mechanisms as required by any particular application. Moreover, a preferred embodiment incorporates means for adjusting both the forward and backward speed of the equipment as well as the rotational speed of the motor(s) driving the brushing, grinding, or polishing wheels.

A second embodiment of the floor grinder/scrubber is a ride-on machine designed and engineered for heavy duty grinding of concrete floors using special planetary heads and grinding pads. Water from a 60-gallon supply tank mounted on the floor grinder/scrubber is supplied to the floor under the grinding pads for the grinding process. The used slurry is vacuumed through a rear squeegee into an 80-gallon recovery tank mounted on the floor grinder/scrubber.

The floor grinder/scrubber can also be used as a floor scrubber for a wide range of applications when equipped with the appropriate scrubbing wheels and can be used in conjunction with other systems providing complete wastewater filtration, recycling and disposal.

BRIEF DESCRIPTION OF THE FIGURES

The features and advantages of this invention, and the manner of attaining them, will become apparent and be better understood by reference to the following description of the embodiments of the invention in conjunction with the accompanying drawings, wherein.

DETAILED DESCRIPTION OF THE PREFERRED EMBODIMENTS

Figure 1:
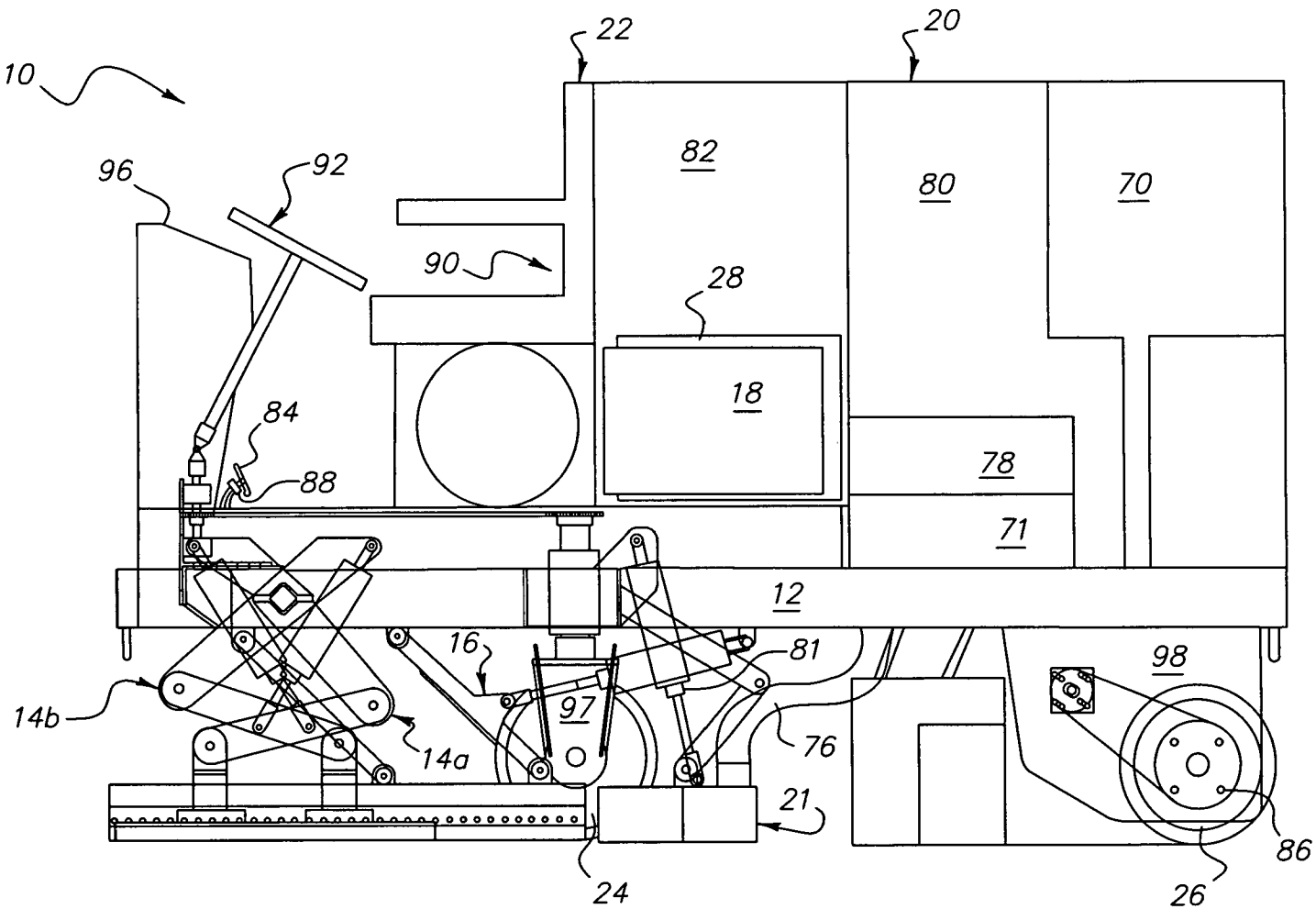
FIG. 1 is a side view of the floor surface scrubbing and resurfacing equipment of the first embodiment of the present invention.

Referring now to FIG. 1, a preferred embodiment of the floor surface scrubbing and resurfacing equipment 10 is shown. Floor surface scrubbing and resurfacing equipment 10 includes frame 12, two frontmost scrubbing/resurfacing mechanisms 14*a* and a rearmost scrubbing/resurfacing mechanism 14*b*, two skirt mechanisms 16, compressor 18, water distribution and collection system 20 having a rear squeegee 21, a vehicle portion 22 including a front wheel 24 and two rear wheels 26, and a hydraulic drive system 28.

Figure 2:
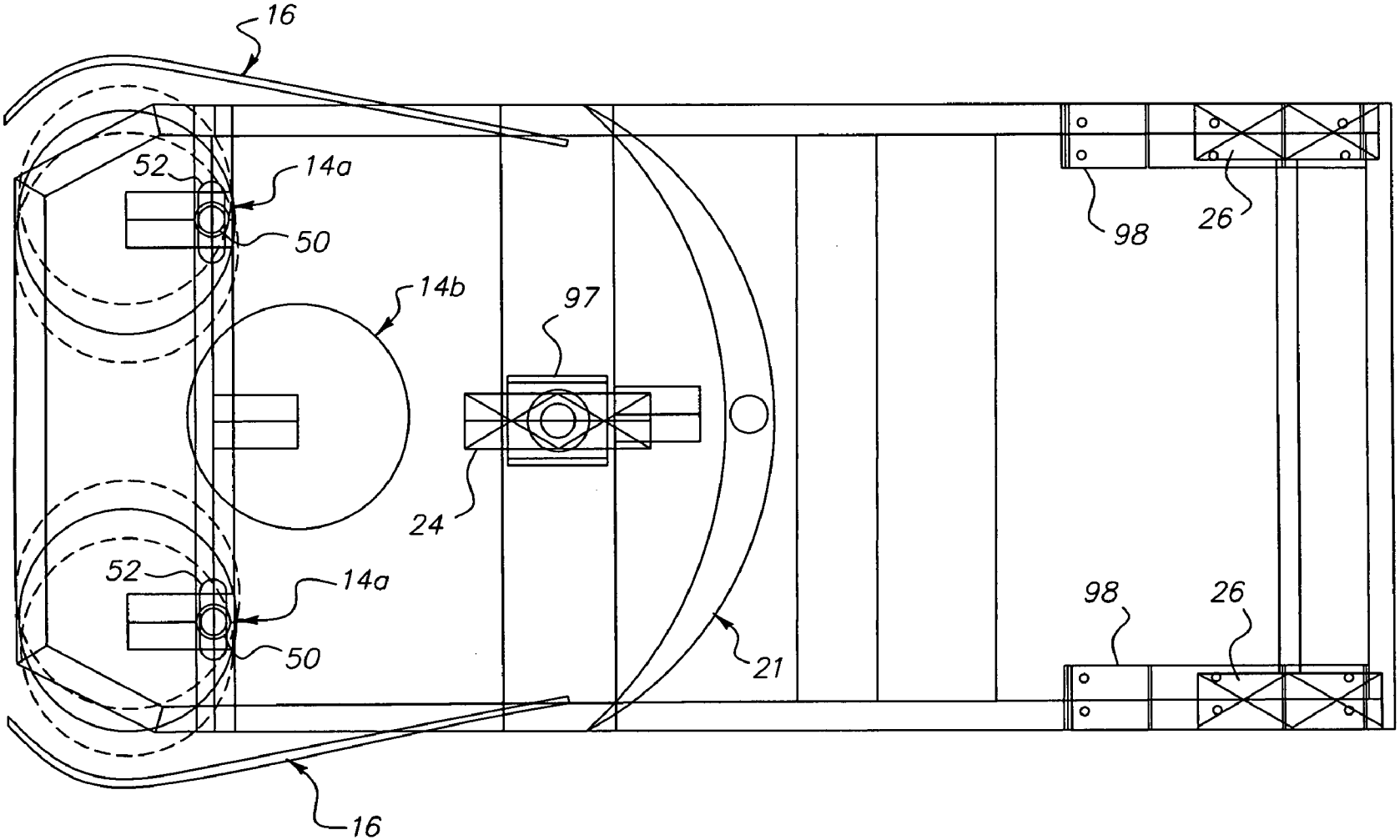
FIG. 2 is a bottom view of the floor surface scrubbing and resurfacing equipment of FIG. 1.
Figure 3:
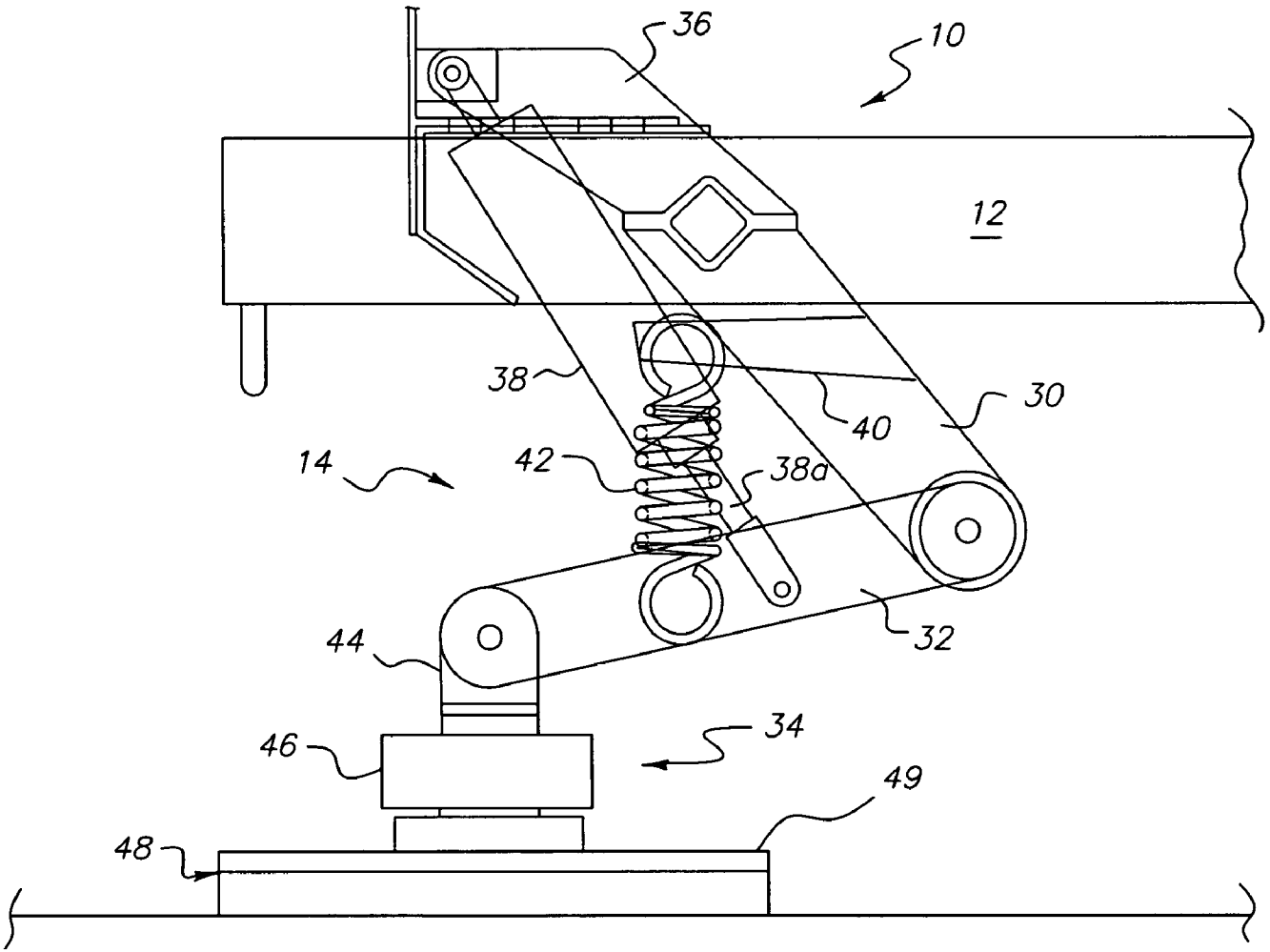
FIG. 3 is a side view of a scrubbing/resurfacing mechanism of the floor surface scrubbing and resurfacing equipment of FIG. 1.

As shown in FIG. 2, the frontmost and rearmost scrubbing/resurfacing mechanisms 14*a* and *b* are situated in front of the front wheel 24. The rearmost scrubbing/resurfacing mechanism 14*b* is centrally located. The two frontmost scrubbing/resurfacing mechanisms 14*a* are configured in substantially the same way and the rearmost scrubbing/resurfacing mechanism 14*b* is configured in substantially the same way as the frontmost scrubbing/resurfacing mechanisms 14*a* except that the rearmost scrubbing/resurfacing mechanism 14*b* is mounted to the frame in the reverse direction to thereby position the rearmost scrubbing/resurfacing mechanism 14*b* behind the frontmost scrubbing/resurfacing mechanisms 14*a*. Therefore, for simplicity, only one of the scrubbing/resurfacing mechanisms 14 will be discussed. Referring now to FIG. 3, the scrubbing/resurfacing mechanism 14 of the floor surface scrubbing and resurfacing equipment 10 is shown. The scrubbing/resurfacing mechanism 14 includes a first linkage 30, a second linkage 32, a scrubbing/resurfacing head 34, cylinder linkage 36, and hydraulic cylinder 38 having a piston 38*a*. The first linkage 30 is affixed to the frame 12 at one end such that the first linkage 30 does not pivot about the fixed end. The second linkage 32 is pivotally connected to the first linkage 30 at one end and is pivotally connected to the scrubbing/resurfacing head 34 at the other end. An arm 40 is affixed to or integral with the first linkage 30. A return spring 42 connects the arm 40 to the second linkage 32 such that the second linkage 32 and thus the scrubbing/resurfacing head 34 are biased towards the frame 12.

The scrubbing/resurfacing head 34 includes a stationary link 44 pivotally connected to the second linkage 32, a hydraulic valve 46, and a brush 48. The brush 48 may be configured in segments that are removably attached to a brush plate 49 by screws, a clasp, or other suitable fastening means. Thus, the separate segments may be replaced independently. A grinding head 48*a* or a polishing head 48*b* may be used in place of the brush 48.

The cylinder linkage 36 is affixed to frame 12 at one end such that the cylinder linkage 36 does not pivot about the fixed end. The hydraulic cylinder 38 is pivotally connected to the cylinder linkage 36. The piston 38*a* is connected to the second linkage 32 via a ball joint to thereby allow some lateral movement of the second linkage 32. In a preferred embodiment, the hydraulic cylinders 38 have a 3-in bore and 4.5-in of travel.

Referring again to FIG. 2, the first linkage 30 connects to the frame by a fastener 50. The fastener 50 may be loosened to allow the first linkage 30 to slide along a slot 52.

Figure 4:
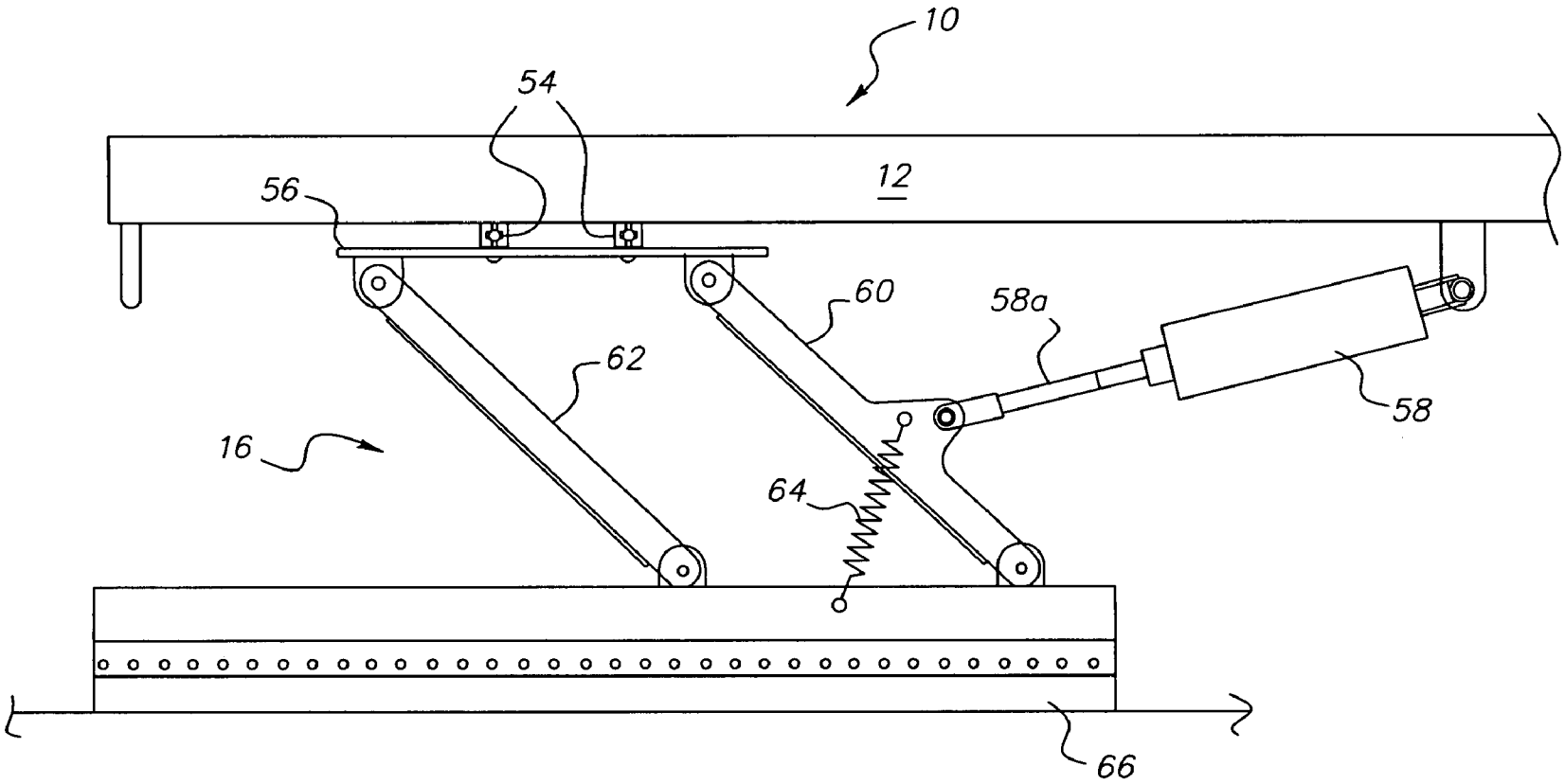
FIG. 4 is a side view of a skirt mechanism of the floor surface scrubbing and resurfacing equipment of FIG. 1.

The two skirt mechanisms 16 are situated on either side of the two front scrubbing/resurfacing mechanisms 14 and have a shape and position to direct water toward the center of rear squeegee 21. The two the skirt mechanisms 16 are configured in substantially the same way. Therefore, for simplicity, only one of the skirt mechanisms 16 will be discussed. Referring now to FIG. 4, the skirt mechanism 16 includes slide rails 54, support plate 56, hydraulic cylinder 58 having a piston 58*a*, rear arm 60, front aim 62, return spring 64, and skirt 66. The slide rails 54 are affixed to the frame 12 such as by welding. The slide rails 54 are substantially parallel to one another and substantially perpendicular to the length of the frame 12. The support plate 56 is fastened to slide rails 54 such that the fasteners may be loosened to allow lateral motion of the support plate 56 along the length of the slide rails 54. The rear arm 60 and the front arm 62 are connected to opposite ends of the support plate 56 such that the rear arm 60 and the front arm 62 pivot about their respective connections to the support plate 56. Similarly, the rear arm 60 and the front arm 62 are pivotally connected to the skirt 66 as shown in FIG. 4. The hydraulic cylinder 58 is pivotally connected to the frame 12 and the piston 58*a* is connected to the rear arm via a ball joint to thereby allow some lateral movement of the rear arm 60. The return spring 64 connects the rear arm 60 to the skirt 66 such that the skirt mechanism 16 is biased in the raised position.

Referring again to FIG. 1, the compressor 18 is situated above the frame 12 and approximately centrally located along the length of the floor surface scrubbing and resurfacing equipment 10. The compressor 18 includes an fluid reservoir 68 and the compressor 18 maintains a predetermined pressure in the fluid reservoir 68 that is determined for each particular application and surface. The compressor 18 is hydraulically connected to the three hydraulic cylinders 38 and the two hydraulic cylinders 58. In a preferred embodiment, the compressor 18 has a maximum of 100-psi which should be sufficient for most applications. The fluid reservoir 68 has a capacity of 3 gallons in the preferred embodiment.

The water distribution and collection system 20 having a rear squeegee 21 includes a water tank 70, a water pump 71, distribution hoses 72, a vacuum hose 76, a vacuum 78, and a wastewater reservoir 80. The water pump 71 is fluidly connected to the water tank 70. The distribution hoses 72 each have an inlet fluidly connected to the water pump 71 and an outlet over one of the scrubbing/resurfacing heads 34 such that each scrubbing/resurfacing head 34 has at least one distribution hose outlet. Alternatively, the water pump 71 is omitted and the water is gravity fed through distribution hoses 72.

The rear squeegee 21 is situated directly behind the front wheel 24 and, as can be seen in FIG. 2, the rear squeegee is arc-shaped to direct water to the center of the rear squeegee 21 while the floor surface scrubbing and resurfacing equipment 10 moves forward. The vacuum hose 76 has an inlet that is fluidly connected to the rear squeegee 21 and an outlet that is fluidly connected to the vacuum 78. The vacuum 78 is also fluidly connected to the wastewater reservoir 80. As best shown in FIG. 1, the rear squeegee 21 is raised and lowered by a hydraulic cylinder 81 which is actuated to lower the rear squeegee 21 when the vehicle portion 22 is put into a forward gear. The rear squeegee 21 is automatically raised when the vehicle portion 22 is put into neutral or reverse.

The vehicle portion 22 includes the front wheel 24, the rear wheels 26, a motor 82, a throttle 84, breaks 86, a break pedal 88, a seat 90, a steering mechanism 92, a gear box 94, and a control panel 96. The seat 90 is situated above the frame 12 towards the front of the floor surface scrubbing and resurfacing equipment 10 as shown in FIG. 1. The motor 82 may be an electric motor powered by batteries or an internal combustion engine for larger applications. The motor 82 is situated in the center of the floor surface scrubbing and resurfacing equipment 10 behind the seat 90. The motor 82 may be configured to drive the rear wheels 26 independently of each other such that one wheel may turn faster than the other while turning corners. The throttle 84 is configured as a foot pedal in front of the seat 90 and is mechanically or electrically coupled to the motor 82 such that pushing down on the throttle 84 increases the speed of the floor surface scrubbing and resurfacing equipment 10. The breaks 86 are coupled to the rear wheels 26. The break pedal 88 is configured as a foot pedal situated to the left of the throttle 84 and is coupled to the breaks 86 such that pushing down on the break pedal 88 increases the break pressure of the breaks on the rear wheels 26. Alternatively, the breaks 86 are omitted and the motor 82 is used to stop the equipment 10 in smaller applications.

The steering mechanism 92 includes a steering wheel configured for turning the front wheel 24 to the left or right. The gearbox 94 is coupled to the motor 82 to provide gear choices such as reverse, neutral, and forward. A shift lever is situated near the seat 90. The control panel 96 is situated near the seat 90 as shown in FIG. 1. The control panel 96 includes switches for starting up the various components including the compressor 18, the hydraulic drive system 28, the water pump 70, the vacuum 78, and the motor 82. The control panel 96 further includes controls to actuate the hydraulic cylinders 38 to lower or raise the scrubbing/resurfacing mechanisms 14 and the hydraulic cylinders 58 to lower or raise the skirt mechanisms 16. The control panel 96 also includes gauges to indicate the level of water in the water tank 70, the level of wastewater in the wastewater reservoir 80, the fluid pressure in the fluid reservoir 68, the hydraulic fluid pressure in the hydraulic drive system 28, and the fuel level for an internal combustion engine.

The front wheel 24 is connected to a front wheel housing 97 by an axle. The front wheel housing 97 is connected to the frame 12 by a bearing such that the front wheel housing 97 may rotate within the frame 12. The front wheel housing 97 is further coupled with the steering mechanism 92 such that turning the steering mechanism 92 to the right will turn the front wheel 24 to the right. The rear wheels 26 are each connected to a respective rear wheel housing 98 by an axle.

The hydraulic drive system 28 includes a hydraulic pump 100 and hydraulic distribution hoses 102. The hydraulic distribution hoses 102 are in fluid communication with the hydraulic pump 100 and the hydraulic valves 46 to form a circuit. The hydraulic pump 100 is configured to pump hydraulic fluid through the hydraulic distribution hoses 102 at high pressure to thereby turn turbines within hydraulic valves 46, which, in turn, rotate the scrubbing/resurfacing heads 34 at high speed.

The on/off switch for the hydraulic drive system 28 is tied is a micro-switch located on the throttle 84 such that the scrubbing/resurfacing head 34 is only rotating while the vehicle is in motion. Further, the hydraulics that actuate the rear squeegee 21 are configured to raise the rear squeegee 21 when the floor surface scrubbing and resurfacing equipment 10 is in neutral or reverse.

Figure 5:
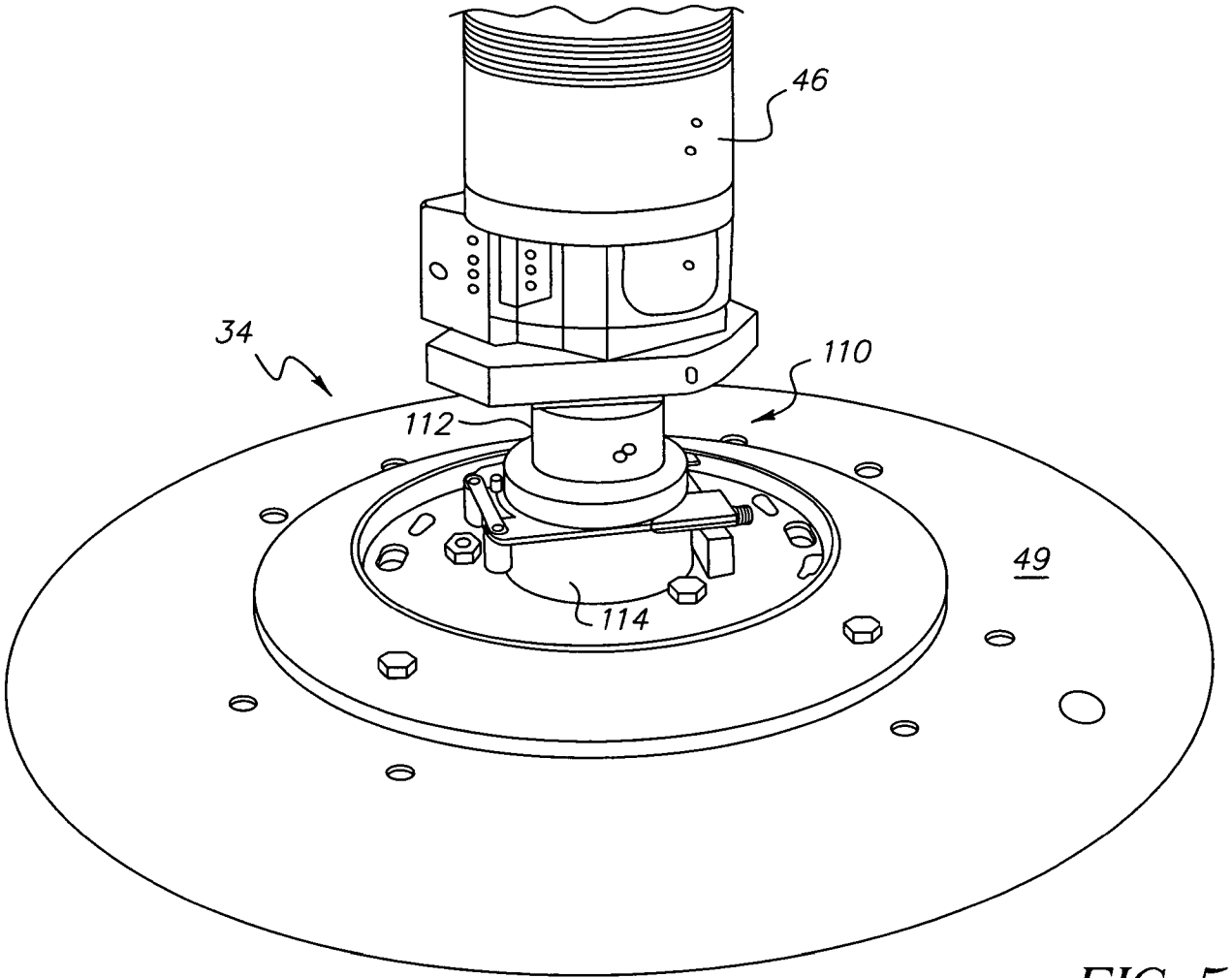
FIG. 5 is an image of the quick-disconnect mechanism of the floor surface scrubbing and resurfacing equipment of FIG. 1.
Figure 6B:
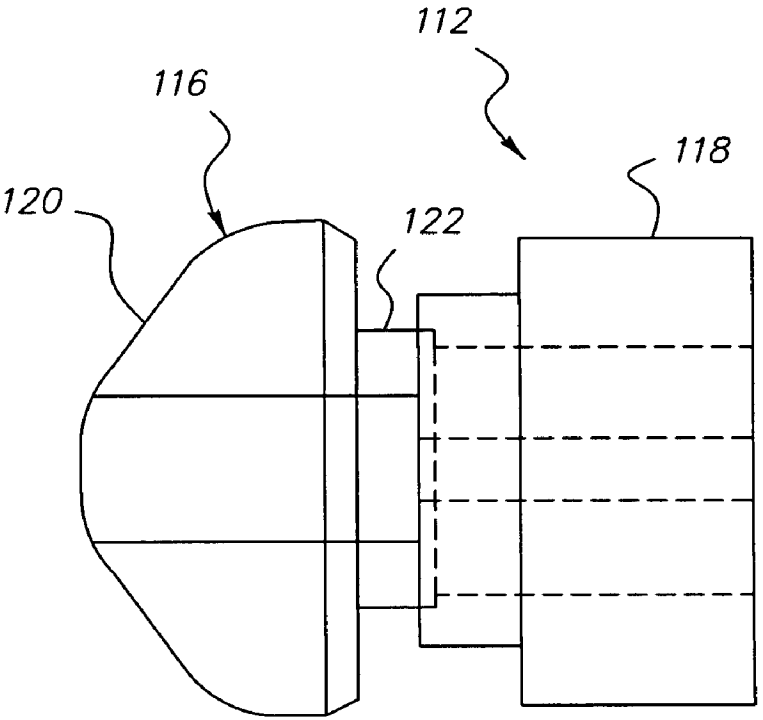
FIG. 6*b* is a side view of the drive knuckle of the quick-disconnect mechanism of FIG. 5.
Figure 6A:
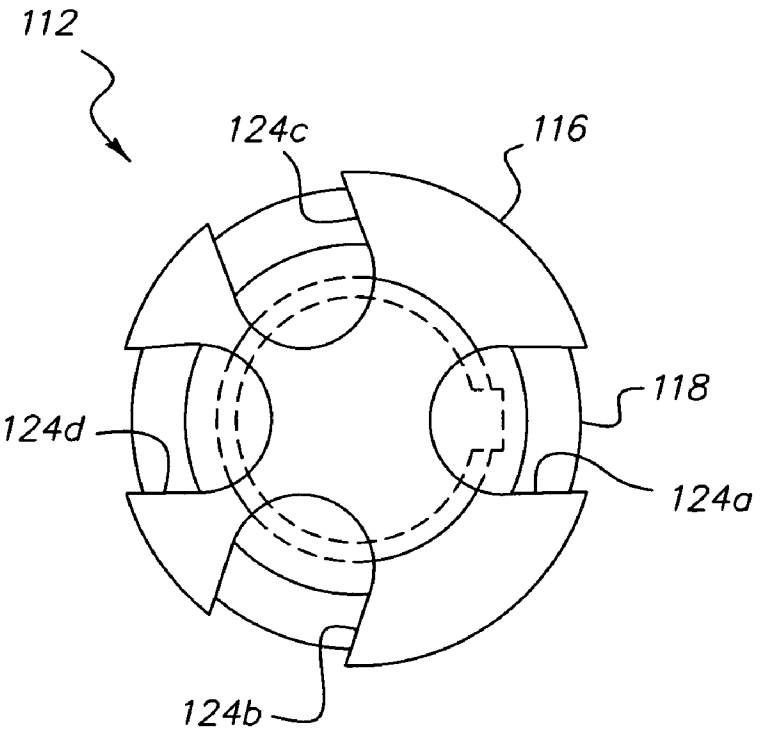
FIG. 6*a* is a front view of the drive knuckle of the quick-disconnect mechanism of FIG. 5.
Figure 6C:
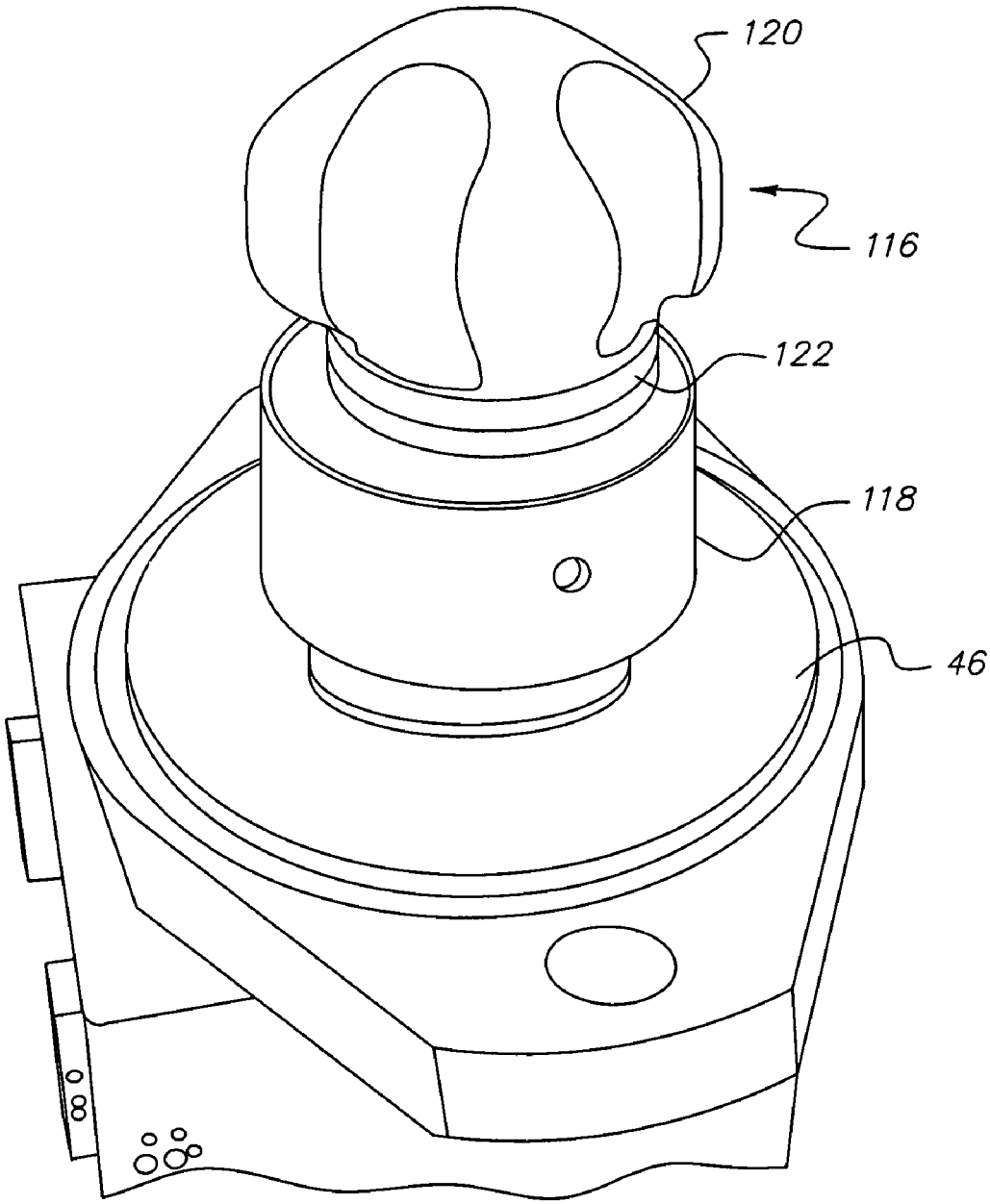
FIG. 6*c* is an image of the hydraulic valve and the drive knuckle of the quick-disconnect mechanism of FIG. 5.

Referring to FIG. 5, the scrubbing/resurfacing mechanism 14 further includes a quick-disconnect mechanism 110 that makes changing the scrubbing/resurfacing head 34 a quick and easy process. The quick-disconnect mechanism 110 includes a drive knuckle 112 and a receptor 114. The drive knuckle 112 is illustrated in FIGS. 6*a* and 6*b*. The drive knuckle 112 includes a drive interface 116 and a keyed adaptor 118. The drive interface 116 includes a somewhat cone-shaped end 120 and a substantially cylindrical projection 122 on the opposite end. The cone-shaped end 120 includes slots 124*a*, 124*b*, 124*c*, and 124*d*. The centerlines of each of slots 124*a*, 124*b*, and 124*c* are approximately 110 degrees from one another. The centerline of slot 124*d* is approximately 180 degrees from slot 124*a*. The projection 122 is welded to a first end 126 of the keyed adaptor 118. The keyed adaptor 118 includes a keyed center bore for receiving the keyed drive shaft of the hydraulic valve 46. A set screw through the side of the keyed adaptor 118 and into the drive shaft holds the keyed adaptor 118 in place. A key couples the drive shaft to the keyed adaptor 118 such that rotation of the drive shaft is transferred to the keyed adaptor 118. FIG. 6*c* shows the drive knuckle 112 assembled to the hydraulic valve 46.

Figure 7:
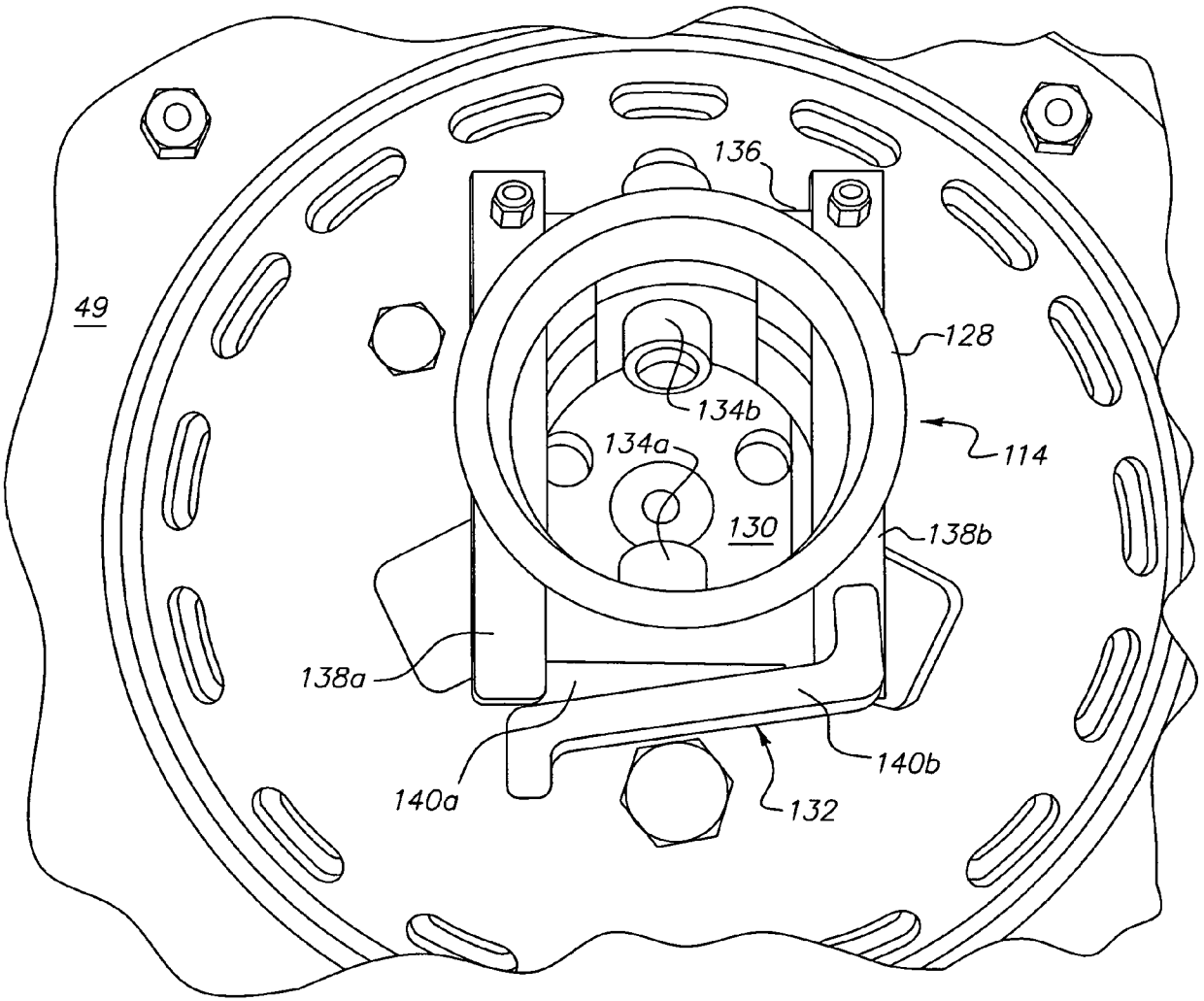
FIG. 7 is an image of the receiver of the quick-disconnect mechanism of FIG. 5.
Figure 8:
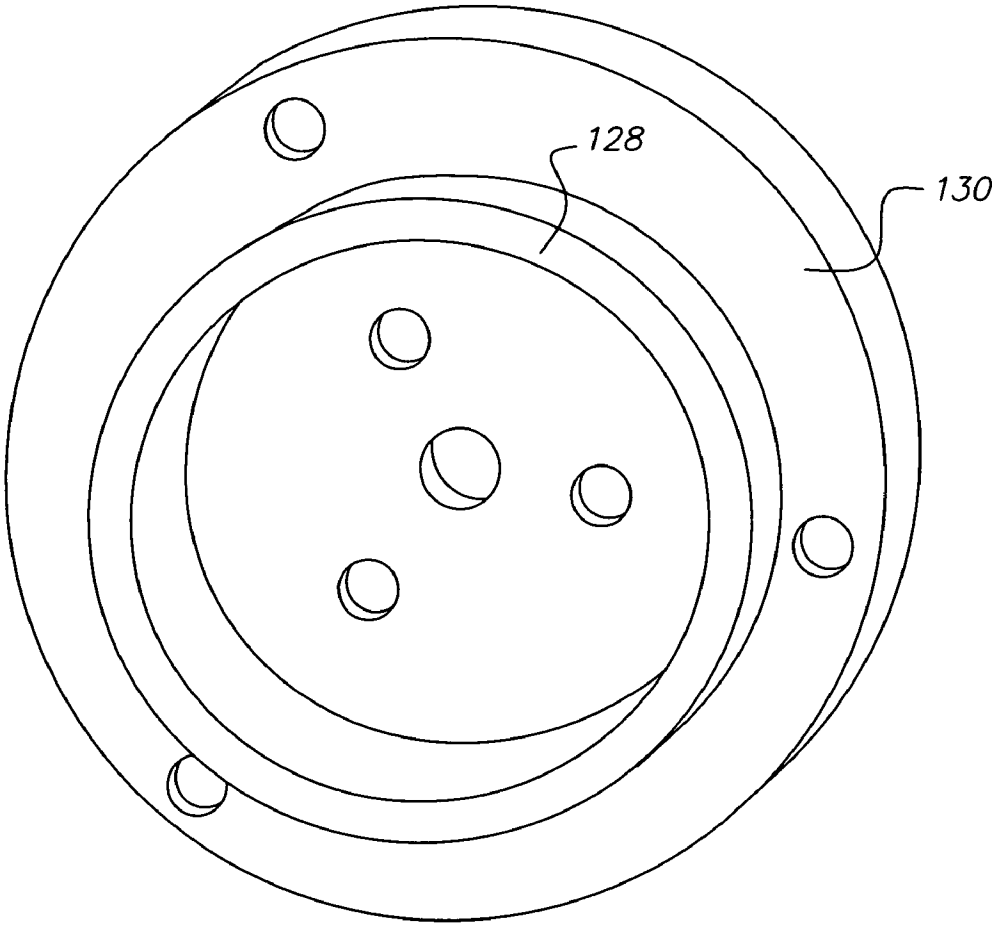
FIG. 8 is a second image of the receiver of the quick-disconnect mechanism of FIG. 5.

As shown in FIG. 7, the receptor 114 includes a cylindrical wall 128, a circular flange 130, a spring loaded clasp 132, and pins 134*a* and 134*b*. The cylindrical wall 128 and the circular flange 130 are best shown in FIG. 8. Referring again to FIG. 7, the circular flange 130 is affixed to the brush plate 49 such as by screws, adhesive or other suitable affixing means. The clasp 132 includes anchor bar 136, lock bars 138*a* and 138*b*, and finger levers 140*a* and 140*b*. The anchor bar 136 is affixed to or integral with the cylindrical wall 128. The lock bar 138*a* is pivotally connected to one end of the anchor bar 136 and the lock bar 138*b* is pivotally connected to the other end of the anchor bar 136. The lock bars 138*a* and *b* each penetrate a side of the cylindrical wall 128 such that the lock bars 138*a* and *b* are slidable within the slots in the sides of the cylindrical wall 128. A torsion spring 139*a* engages the pivotal connection of the lock bar 138*a* to the anchor bar 136 to bias the lock bar 138*a* into the slot in the cylindrical wall 128. Similarly, torsion spring 139*b* engages the pivotal connection of the lock bar 138*b* to the anchor bar 136 to bias the lock bar 138*b* into the slot in the cylindrical wall 128. The finger levers 140*a* and 140*b* are affixed to or integral with a respective lock bar 138*a* or 138*b*. The pins 134*a* and 134*b* are affixed to or integral with the inner surface of the cylindrical wall 128 and are substantially directly opposite to one another. In an alternate configuration, there are three pins 134*c*, 134*d*, and 134*e*, each having an axis approximately 110 degrees from one another.

When the quick disconnect mechanism 110 is engaged, the lock bars 138*a* and *b* rest behind the cone-shaped end 120 of the drive interface 116, proximate to the projection 122. The two pins 134*a* and 134*b* engage the slots 124*a* and 124*d*, respectively to transfer rotation of the drive knuckle 112 to the receptor 114, and thus to the brush 48. In the alternative having three pins, the pins 134*c*, 134*d*, and 134*e* engage the slots 124*a*, 124*b*, and 124*c*, respectively. Therefore, the drive knuckle 112 can accommodate multiple receptor configurations.

In use, the floor surface scrubbing and resurfacing equipment 10 must first be configured for the particular application. The force applied to the scrubbing/resurfacing mechanisms 14 is independently variable by separately adjusting the fluid pressure applied to the pistons 38*a* in the hydraulic cylinders 38. The force applied is determined for each particular application. The factors to consider include the application, such as sweeping, grinding, polishing, etc., the coefficient of friction between the brush 48 or grinding head 48*a* or polishing head 48*b* and the floor surface, and the flatness of the floor surface. An application with a high coefficient of friction may require a lower force applied to the scrubbing/resurfacing mechanisms 14 to avoid stalling the brush 48 or grinding head 48*a* or polishing head 48*b*. Also, a particularly wavy floor surfaces may require a higher force applied to the scrubbing/resurfacing mechanisms 14 to ensure contact with the high and low areas of the floor surface. In the preferred embodiment, the operable range of pressures applied to each of the pistons 38*a* in a scrubbing application is approximately 0.5-psi to 1.5-psi.

Similarly, the force applied by the pistons 58*a* on the skirt mechanisms 16 must also be adjusted. The factors to consider include the skirt 66 material and the abrasiveness of the floor surface. The downward force should be sufficient to prevent the wastewater from passing by the skirts 66 such that it is guided to the rear squeegee 21. A downward force that is too high may cause excessive drag on the floor surface scrubbing and resurfacing equipment 10. Further, an excessive downward force may cause damage to the skirts 66, particularly when applied to an abrasive floor surface.

The lateral position of the scrubbing/resurfacing mechanisms 14 and the skirt mechanisms 16 may also be adjusted. The lateral position of the scrubbing/resurfacing mechanisms 14 may be adjusted by loosening fasteners 50 and sliding the first linkage 30 along a slot 52. The range of lateral motion of the scrubbing/resurfacing mechanisms 14 is limited by the range of motion allowed by the ball joint between the piston 38*a* and the second linkage 32. Similarly, the skirt mechanisms 16 are adjusted by loosening the fasteners and sliding the support plate 56 along the slide rails 54. The range of lateral motion of the skirt mechanisms 16 is limited by the range of motion allowed by the ball joint between the piston 58*a* and the rear arm 60. Moving the scrubbing/resurfacing mechanisms 14 toward each other decreases the coverage area while increasing the overlap in coverage between the frontmost brushes 48, grinding heads 48*a*, or polishing heads 48*b* and the rearmost brush 48, grinding head 48*a*, or polishing head 48*b*. Alternatively, widening the scrubbing/resurfacing mechanisms 14 increases the coverage area while decreasing the overlap in coverage between the frontmost brushes 48, grinding heads 48*a*, or polishing heads 48*b* and the rearmost brush 48, grinding head 48*a*, or polishing head 48*b*. A larger coverage area is desirable in cleaning applications using brushes 48, while more overlap in coverage between the front grinding heads 48*a* and the rear grinding head 48*b* is desirable in a grinding application.

Once the adjustments are made, the user may start up the components of the floor surface scrubbing and resurfacing equipment 10 using the control panel 96. The user puts the gearbox 94 into a forward gear while actuating the brakes. The rear squeegee 21 is automatically lowered. The user actuates the compressor 18 to lower the scrubbing/resurfacing mechanisms 14 and the skirt mechanisms 16. Then actuates the water distribution and collection system 20, which pumps water through the distribution hoses 72 to the scrubbing/resurfacing heads 34 and activates the vacuum 78. Releasing the brakes and pressing the throttle 84 actuates the micro-switch for activating the hydraulic drive system 28.

The floor surface scrubbing and resurfacing equipment 10 is now moving in the forward direction. The water cools the brush 48, grinding head 48*a*, or polishing head 48*b* and carries any dirt or particles of the floor surface away from the scrubbing/resurfacing heads 34 as wastewater. The skirts 66 guide the wastewater to the rear squeegee 21. The vacuum 78 draws the wastewater into the vacuum hose 76 and outlets the wastewater into the wastewater reservoir 80.

The floor surface scrubbing and resurfacing equipment 10 is able to drive up to a wall ensuring coverage up to the wall by the frontmost scrubbing/resurfacing heads 14*a*. The user may still turn left or right because of the three wheel configuration of the vehicle portion 22. The configuration of the scrubbing/resurfacing mechanisms 14 having the rearmost scrubbing/resurfacing mechanism 14*b* in front of the front wheel 24 ensures that substantially no part of the floor surface that passes under the floor surface scrubbing and resurfacing equipment 10 is missed by the scrubbing/resurfacing mechanisms 14 while the equipment is turning a corner.

In order to attach the brush 48 to the hydraulic valve 46 using quick-disconnect mechanism 110, the pins 134*a* and *b* are lined up with the slots 124*a* and *d* and the receptor 114 is pushed onto the drive knuckle 112 such that the lock bars 138*a* and *b* are forced outward by the cone-shaped end 120 of the drive interface 116. When the drive knuckle 112 fully engages the receptor 114, the lock bars 138*a* and *b* are forced back into place by torsion springs 139*a* and *b*. The lock bars 138*a* and *b* now rest behind the cone-shaped end 120 of the drive interface 116 and hold the receptor 114 onto the drive knuckle 116. This procedure is the same for the three-pin alternative except that the pins 134*c, d*, and *e* are lined up with the slots 124*a, b*, and *c*.

Figure 9:
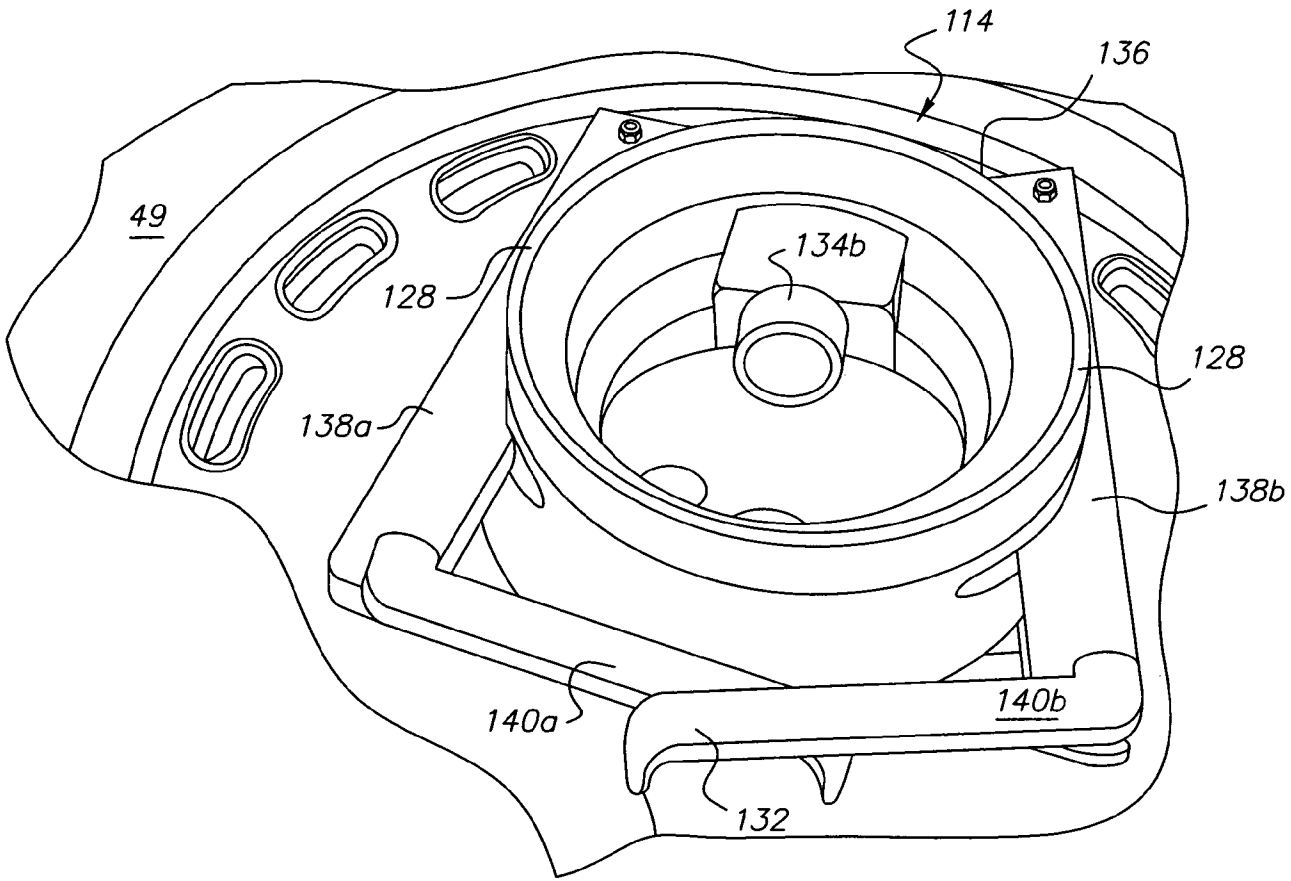
FIG. 9 is an image of the receiver of the quick-disconnect mechanism of FIG. 5 in the open position.

To detach the brush 48 from the hydraulic valve 46 using the quick-disconnect mechanism 110, the finger levers 140*a* and 140*b* are depressed as shown in FIG. 9. This forces the lock bars 138*a* and *b* out from behind the cone-shaped end 120 of the drive interface 116 and the receptor 114 easily slides off the drive knuckle 112. As the finger levers 140*a* and *b* are released, the torsion springs force the lock bars 138*a* and *b* back into the slots in the cylindrical wall 128.

It should be particularly pointed out that in the preferred embodiment, the compressor 18 has a maximum output of 100-psi and the fluid reservoir 68 has a 3-gallon capacity. The hydraulic cylinders 38 and 58 have a 3-inch bore and 4.5-inches of travel.

It should further be particularly noted that a desirable advantage of the preferred embodiment is that the present invention is configured such that all the scrubbing/resurfacing mechanisms 14 are situated in front of the front wheel 24 such that the present invention maintains substantially complete coverage of the surface while turning a corner whereas the conventional configuration of having one scrubbing/resurfacing mechanism behind the front wheel may leave uncovered areas on the surface at turns.

It should even further be particularly noted that the advantages of situating the rear squeegee 21 directly behind the front wheel 24 as described in the preferred embodiment rather than behind the rear wheels 26 as in the conventional art include the fact that the rear wheels and other components that may be included with the floor surface scrubbing and resurfacing equipment 10 are kept substantially clean and dry because the majority of the wastewater is picked up by the water distribution and collection system 20 prior to reaching these components. Further, less wastewater is lost out the side of the floor surface scrubbing and resurfacing equipment 10 while turning than is lost in the conventional art.

Figure 10A:
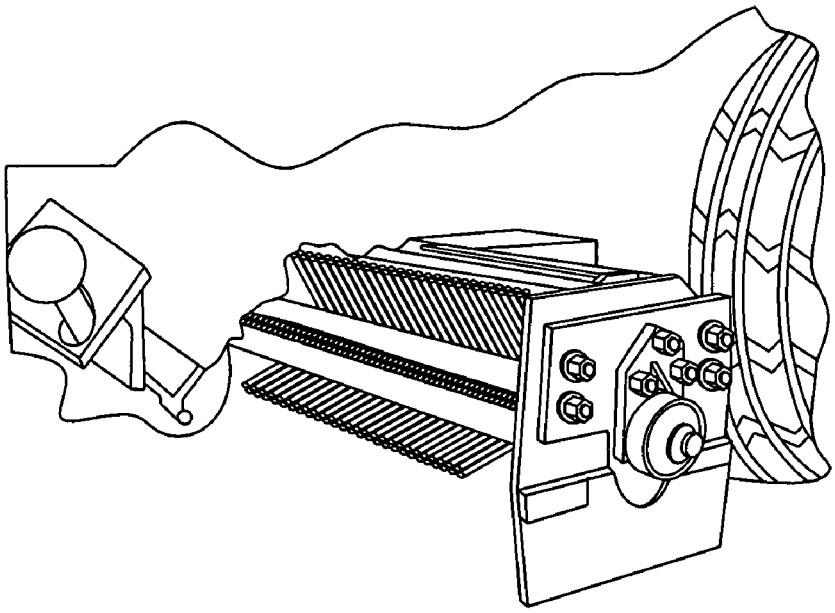
FIG. 10*a* is an illustration showing a sweeper in detail.
Figure 10B:
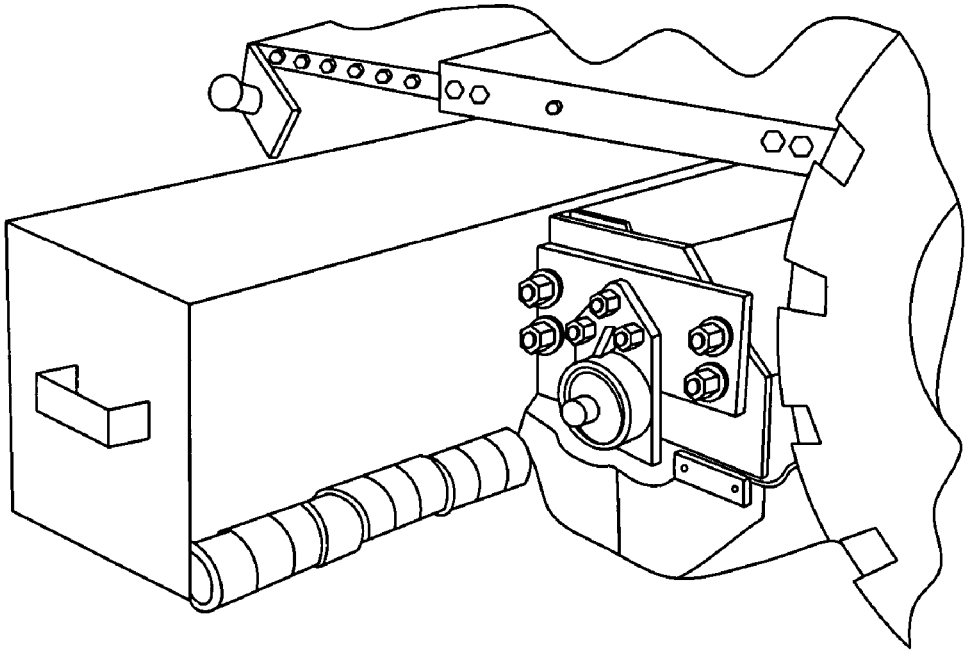
FIG. 10*b* is an illustration showing a vacuumized debris hopper along with the sweeper of FIG. 10*a;*

It should still further be particularly noted that the floor scrubbing and resurfacing equipment 10 may include a sweeper such as the one shown in FIGS. 10*a* and 10*b*. Sweepers are often used alternatively with the water distribution and collection systems in the conventional art. In the present invention, however, the sweeper may be used in conjunction with the water distribution and collection system 20 because the rear squeegee 21 collects the wastewater prior to reaching the sweeper in the preferred embodiment.

In the preferred embodiment, the rear squeegee 21 is located directly behind the front wheel 24. Alternatively, the rear squeegee 21 may be located behind the rear wheels 26. Further in the preferred embodiment, the rearmost scrubbing/resurfacing mechanism 14*b* is located in front of the front wheel 24. Alternatively, the rearmost scrubbing/resurfacing mechanism 14*h* may be located behind the front wheel 24.

In an alternative, the floor surface cleaning and resurfacing equipment of the present invention is configured in a walk behind unit rather than the vehicle configurations described above.

Figure 11:
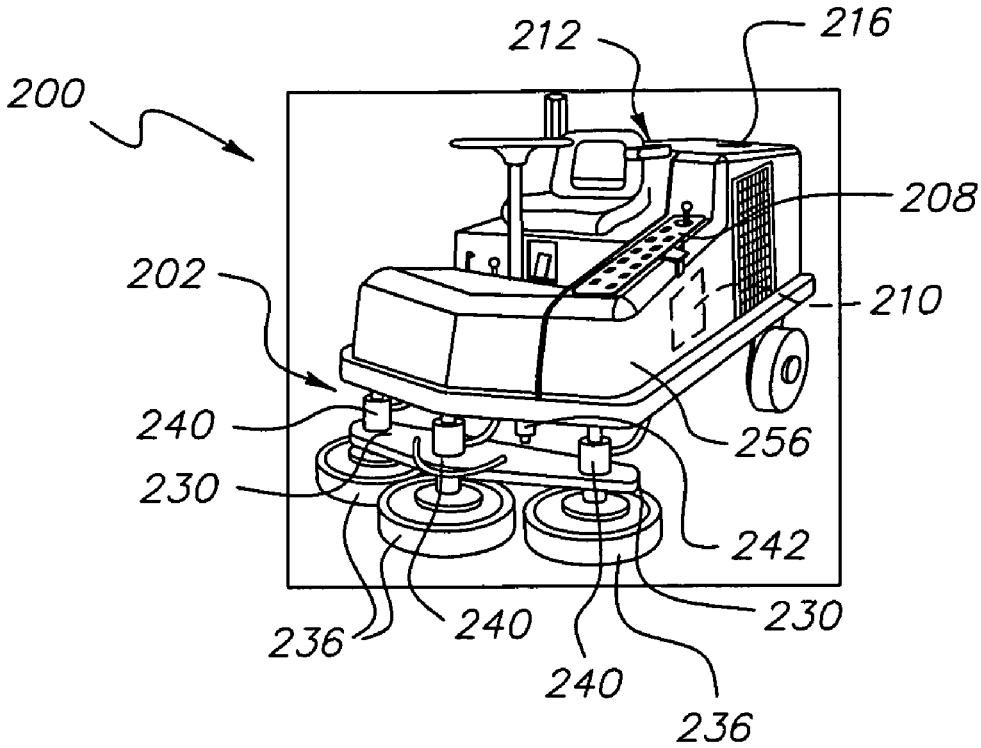
FIG. 11 is a perspective view of the floor grinder/scrubber of the second embodiment.

In a more preferred embodiment, the floor grinder/scrubber 200 shown in FIG. 11 is an industrial duty, ride-on machine for grinding concrete floors or scrubbing floors.

The floor grinder/scrubber 200 grinding system, including a planetary head mounting deck 202, a hydraulic system 204, a water distribution and collection system 206 and controls 208, provides for precise grinding performance and machine maneuvering during the grinding or scrubbing operation.

Figure 12:
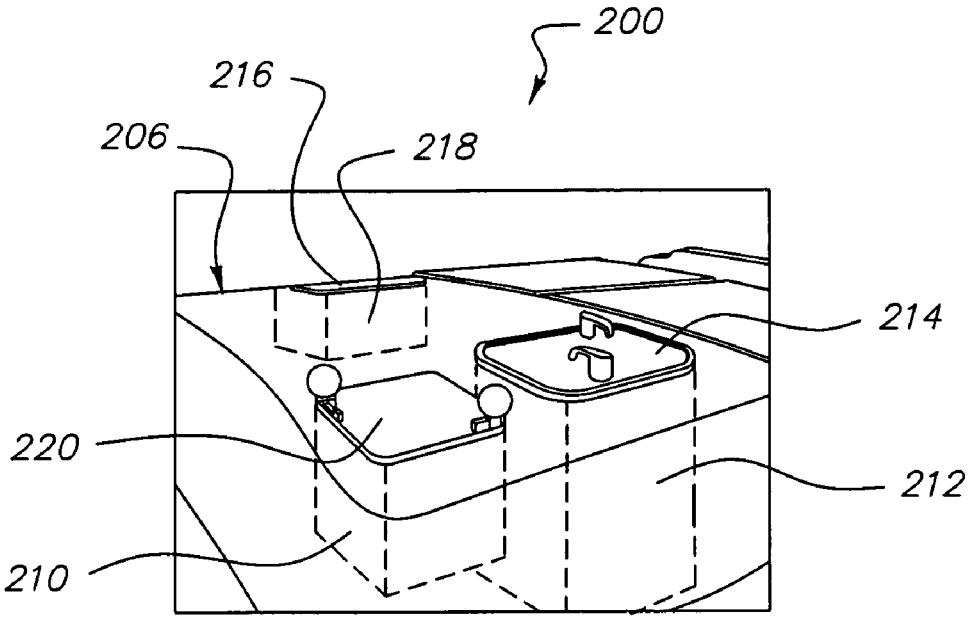
FIGS. 12 and 13 are images of the rear of the floor grinder/scrubber of FIG. 1.
Figure 13:
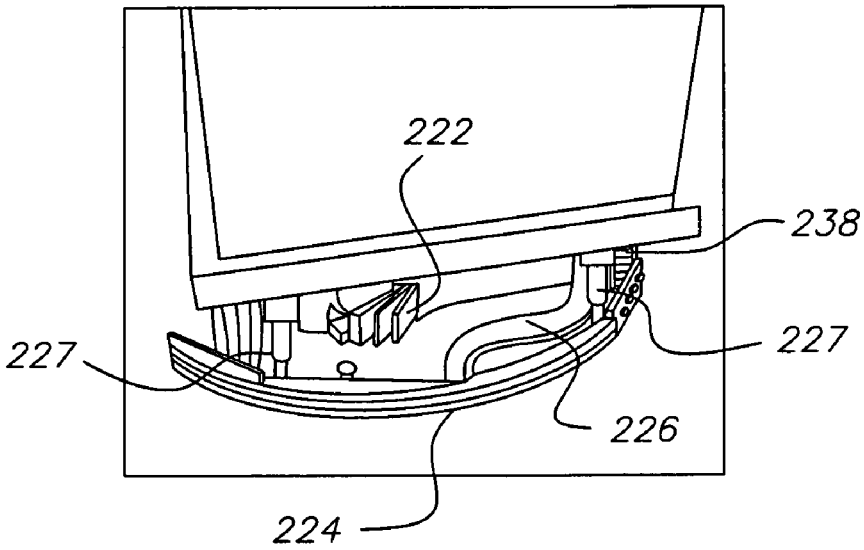
Figure 14:
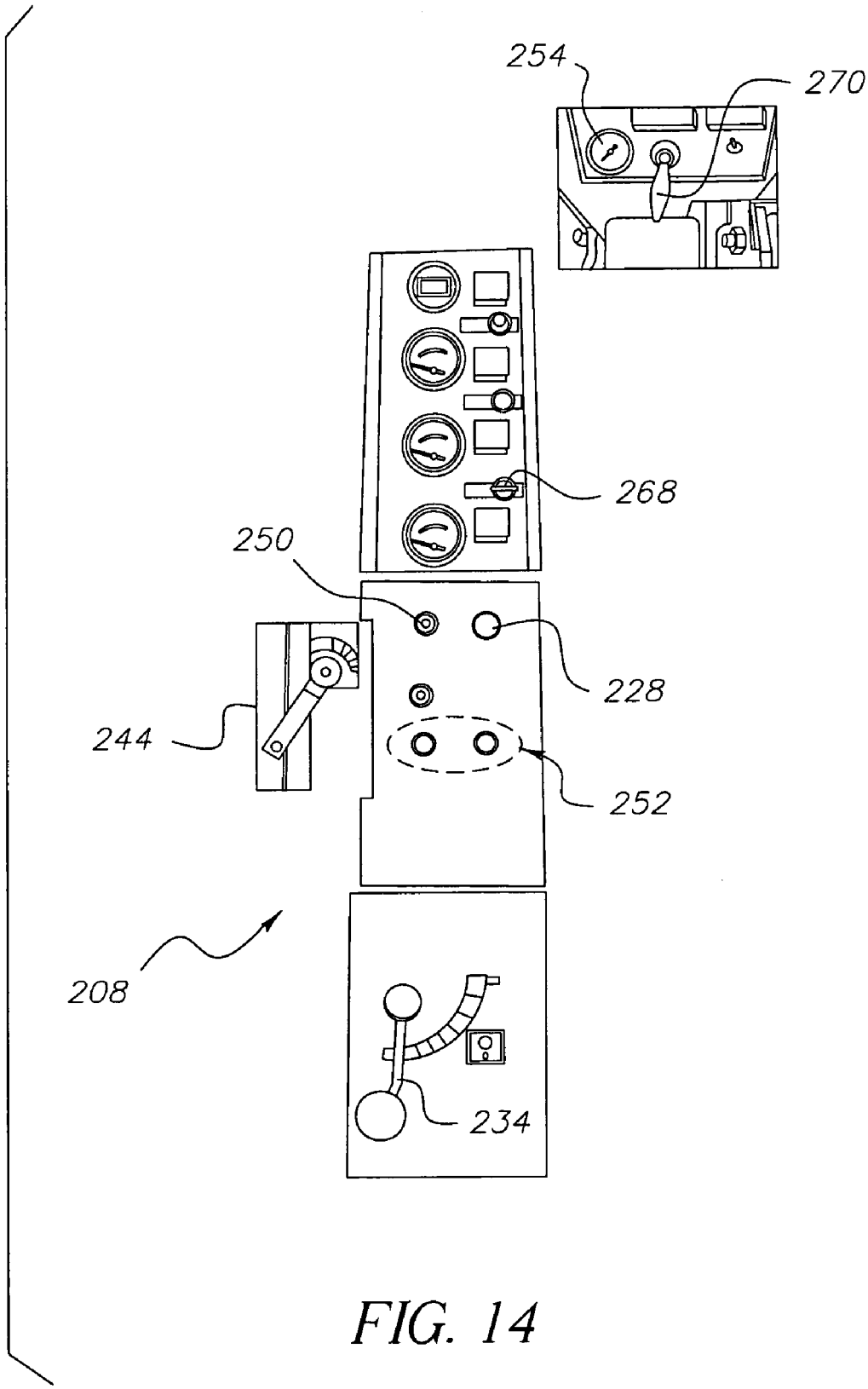
FIG. 14 is an image of the instruments and controls of the floor grinder/scrubber of FIG. 1.

The water distribution and collection system 206 shown in FIGS. 12 and 13 includes a vacuum system 210 that recovers the grind slurry or scrub water into an recovery tank 212. The recovery tank 212 has a level sensor that shuts off the vacuum 210 when the level of the recovered water or slurry reaches the capacity of the recovery tank 212. The recovery tank 212 also includes a clean out port 214 on the top of the floor grinder/scrubber 200. A fill port 216 for a supply tank 218 is on the top of the floor grinder/scrubber 200, opposite to the clean out port 214. A clean out port 220 for the vacuum 210 is also located on the top of the floor grinder/scrubber 200. FIG. 13 shows the drain hose 222 connected to the recovery tank 212. The drain hose 222 is used to drain the waste water in the recovery tank 212. A rear squeegee 224 and vacuum hose 226 are connected to the vacuum system 210. The rear squeegee 224 can be raised or lowered by hydraulic cylinders 227 using the squeegee control 228 (FIG. 14). Lowering the rear squeegee 224 also activates the vacuum system 210. The rear squeegee 224 directs used slurry toward the vacuum hose 226. The vacuum system 210 draws the slurry through the vacuum system 210 into the recovery tank 212. FIG. 11 shows the water outlet tubes 230, which direct the slurry or scrub water over the planetary heads 232. The slurry or scrub water is pumped or gravity fed from the supply tank 218 and the flow is controlled by the solution supply control 234 on the control panel 208. Each of the planetary heads 232 is surrounded by a shroud 236, which directs the slurry or scrub water to the floor below the planetary heads 232.

Figure 11A:
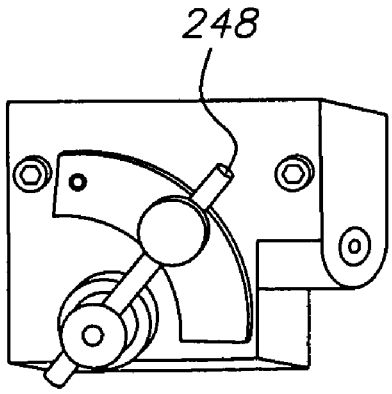
FIG. 11*a* is an image of the grind motor speed lever of the floor grinder/scrubber of FIG. 1.
Figure 15:
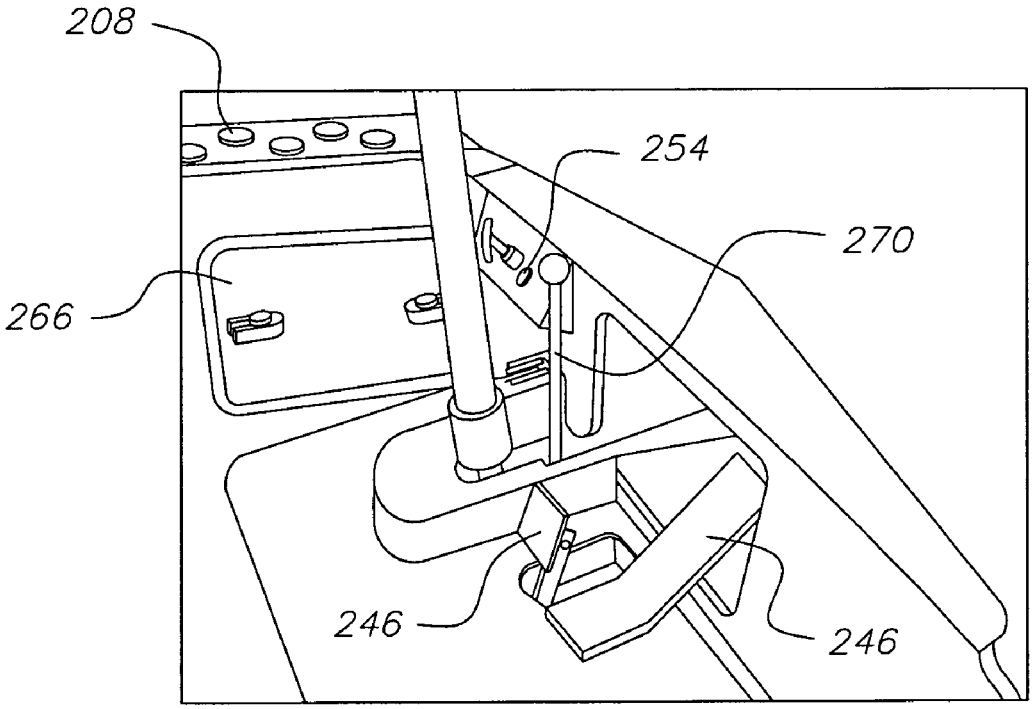
FIGS. 15 and 16 are images of the front end of the floor grinder/scrubber of FIG. 1.
Figure 16:
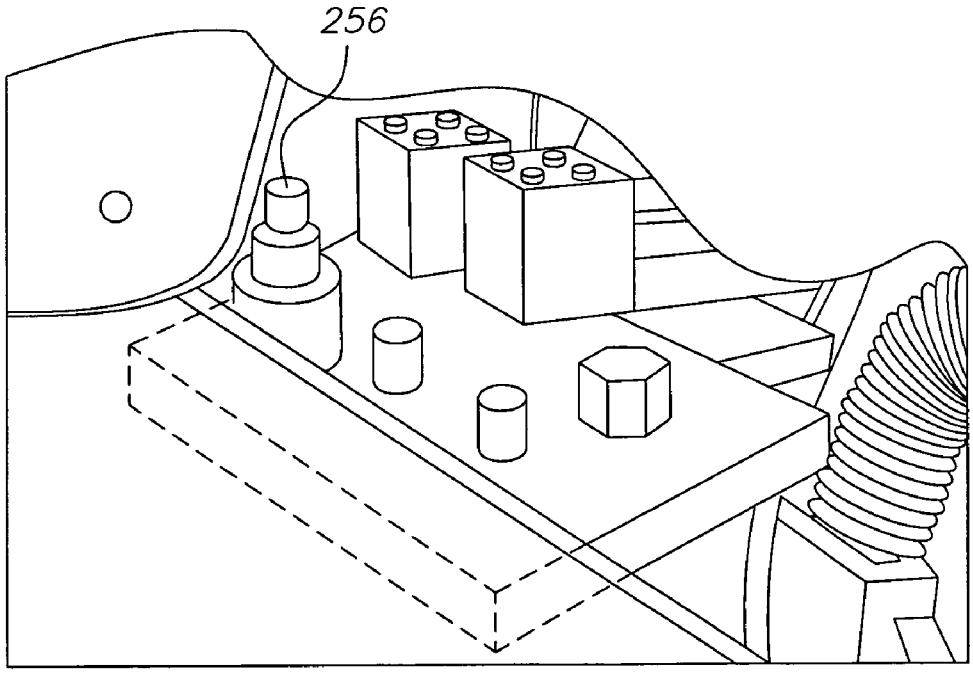

The hydraulic system 204 includes a pump that is driven directly by the engine and has an output of 8 gallons per minute. The hydraulic system 204 supplies power from the engine to the motor for the drive wheel 238 (the right rear wheel), the three grinding/scrubbing head motors 240, the squeegee cylinders 227 and deck cylinders 242. The speed of the motor for the drive wheel 238 is controlled by the forward speed control 244 shown in FIG. 14. The motor for the drive wheel 238 is engaged in forward, reverse, or dynamic breaking by the foot pedals 246 shown in FIG. 15. The foot pedals 246 do not control the speed of the drive wheel 238, only the forward speed control 244 does this. The reverse speed is fixed. The speed of the grinding/scrubbing head motors 240 is controlled separately from the forward speed by a grind motor speed lever 248 shown in FIG. 11*a*. The grinding/scrubbing head motors 240 are activated by grinder control 250. The hydraulics driving the grinding/scrubbing head motors 240 form a circuit such that the hydraulic fluid travels from the engine, to each of the motors in succession and back to the engine. The squeegee cylinders 227 are activated by the squeegee control 228 as stated above. The deck cylinders 242 are controlled by deck lift controls 252 to raise and lower the mounting deck 202. The down pressure gauge 254 indicates the pressure that the deck cylinders 242 apply to the mounting deck 202. This down pressure is adjusted by the down pressure manifold 256 shown in FIG. 16. A down pressure of 200-psi to 600-psi is desirable for most scrubbing and grinding operations.

Figure 17A:
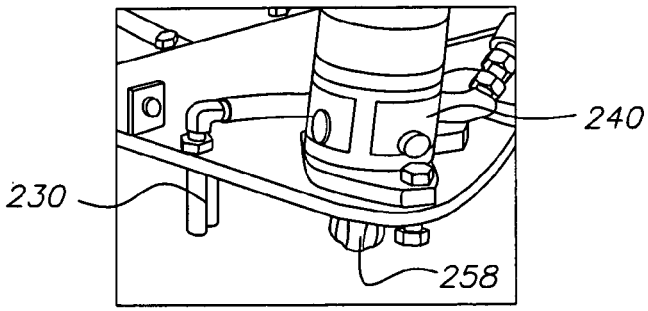
FIGS. 17*a*-17*e* are images of the planetary heads and drive motors of the floor grinder/scrubber of FIG. 1.
Figure 17B:
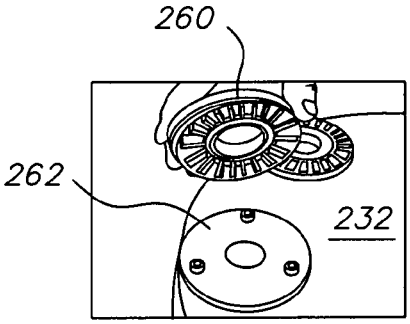
Figure 17C:
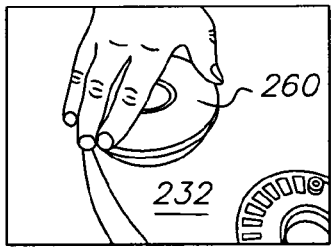
Figure 17D:
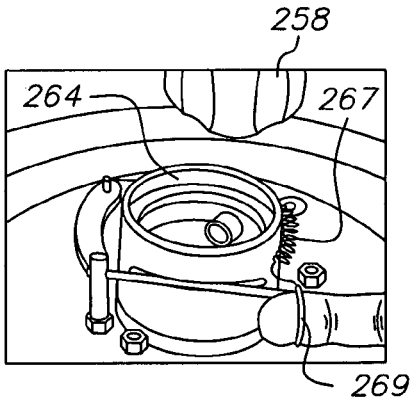
Figure 17E:
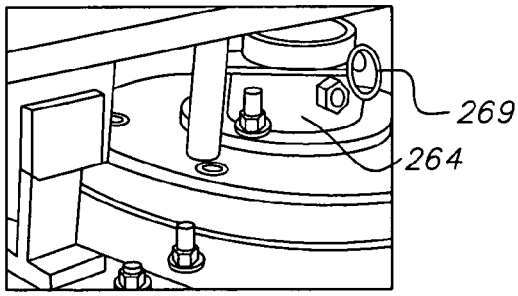

The details of one planetary head 232 are shown in FIGS. 17*a*-17*e*. The drive motor 240 is mounted on mounting deck 202 and includes a spindle 258, which is similar to that described in the first embodiment. FIGS. 17*b* and 17*e* show the installation of a media pad 260 to a grinding planetary head 232. The media pad 260 is pressed firmly onto a rotating planetary carrier 262. This configuration allows the grind media 260 to be changed easily. FIGS. 17*d* and 17*e* show how the planetary head 232 connects to the drive motor 240. Similarly to the first embodiment, a head chuck 264 affixed to the planetary head 232 engages the spindle 258. The system has an interlock that prevents the drive motors 240 from turning on while the mounting deck 202 is in the raised position to prevent damage to the machine or nearby objects.

To use the grinder/scrubber 200, fill the supply tank 218 with the proper solution as required for the scrubbing or grinding application. A solution of detergent and water is desirable for scrubbing applications and a grinding slurry is desirable for grinding applications. Mount the appropriate planetary heads 232 on the grinding motor spindles 258 as shown in FIGS. 17*a*-17*e* and as described above. Start the engine and allow it to warm up for at least 5 minutes to warn the hydraulic fluid. A longer warm-up period may be required in colder weather. Start the engine using the ignition switch 268 and adjust the engine speed with the engine speed control throttle 270.

Set the Grind Motor Speed for the application by changing the position of the grind motor speed lever 248 and securing the position selected. The recommended motor speed range is 80-190 rpm. Lower the rear squeegee 224 using the squeegee control 228 on the control panel 208. For certain applications, the rear squeegee 224 is not used for the initial passes of the grinding operation. Lower the planetary head mounting deck 202. Lowering the deck 202 without the planetary heads 232 could severely damage the spindles 258. Start the solution flow through the water outlet tubes 230, over the planetary heads 232 to the floor with the solution supply control 234 on the control console 208. Adjust the solution flow to the desired level with the solution supply control 234. Start the grinding/scrubbing head motors 240 using the grinder control 250 on the console 208. Release the parking brake and use the foot pedals 246 to start the floor grinder/scrubber 200 moving over the area to be scrubbed or ground. Set the forward speed with the forward speed control 244 on the console 208. To stop the machine, the foot pedal 246 is released. The pedal will return to the middle position and the dynamic brake will stop the floor grinder/scrubber 200. The foot pedals 246 are also used to set the parking break and to move in the reverse direction. Pressing down further on the foot pedal 246 will not cause the floor grinder/scrubber 200 to increase speed in either the forward or reverse directions. The forward speed is controlled by the forward speed control 244 on the console 208. Thus, a consistent forward speed is provided for grinding and scrubbing operations.

If the speed of the grinding/scrubbing head motors 240 needs to be adjusted, bring the floor grinder/scrubber 200 to a complete stop using the dynamic break and set the parking brake using the foot pedals 246. Then turn the forward speed control 244 to the lowest setting and adjust the speed of the grinding/scrubbing head motors 240 using the grind motor speed lever 248. When the grinding or scrubbing operation is compete, stop the floor grinder/scrubber 200 by releasing pedal 246 and firmly pressing down on the brake pedal (left pedal). Lock the parking brake while continuing to engage the parking brake. Turn off the solution flow using the solution supply control 234. Turn off the ignition and set the engine speed throttle 270 to the lowest setting. Then drain the recovery tank 212 by unclamping the drain hose 222 and clean thoroughly by rinsing with water or cleaning solutions. Also, clean the recovery tank filter 266 shown in FIG. 15. If the floor grinder/scrubber 200 is to be stored, also drain and clean out the solution tank 218.

It should be noted that heads designed for dry polishing may be mounted to the grinding/scrubbing head motors 240. For dry polishing, the vacuum hose 226 is connected directly to the shrouds 236.

Figure 18:
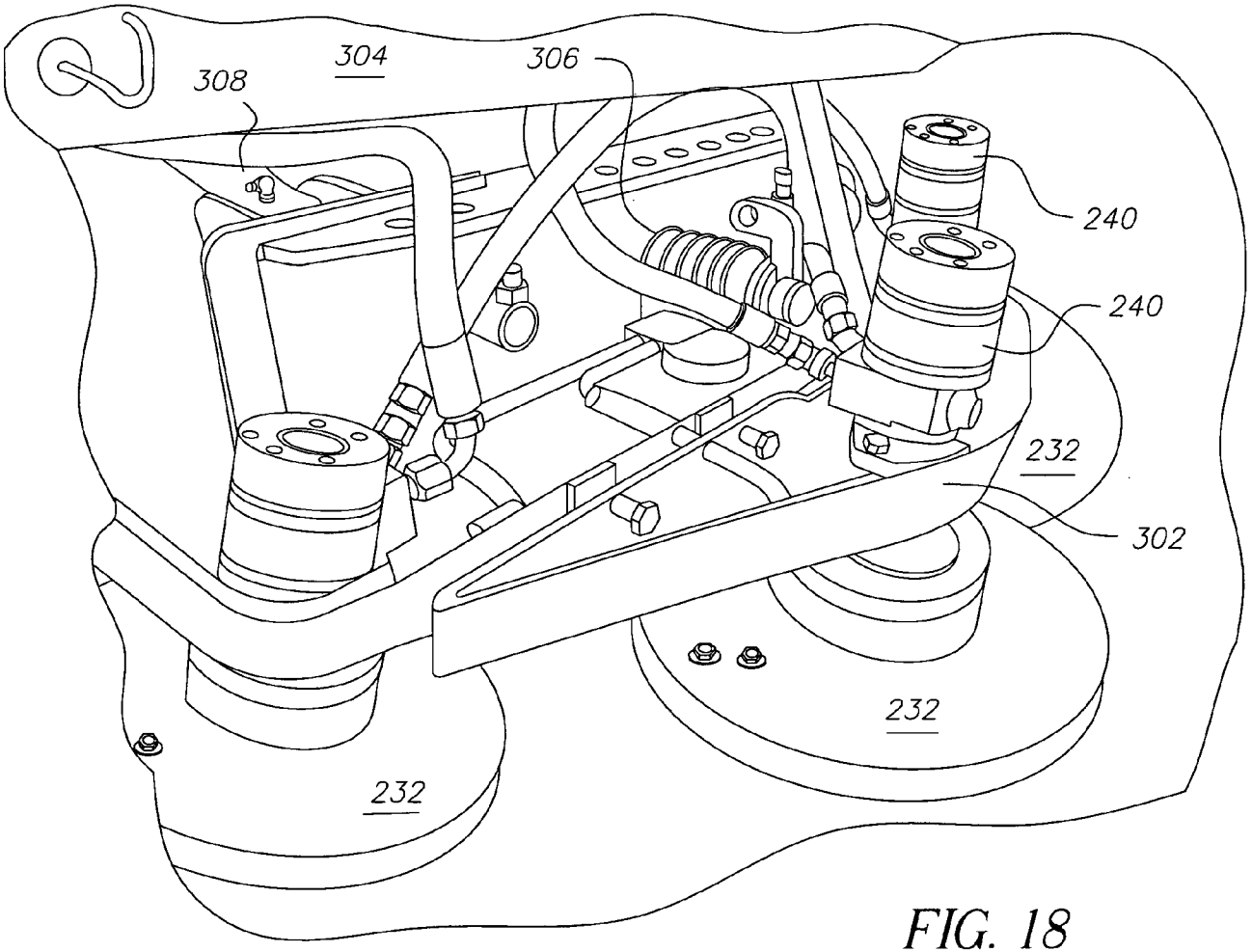
FIGS. 18-20 are images of a mounting deck of the floor grinder/scrubber of FIG. 1.
Figure 19:
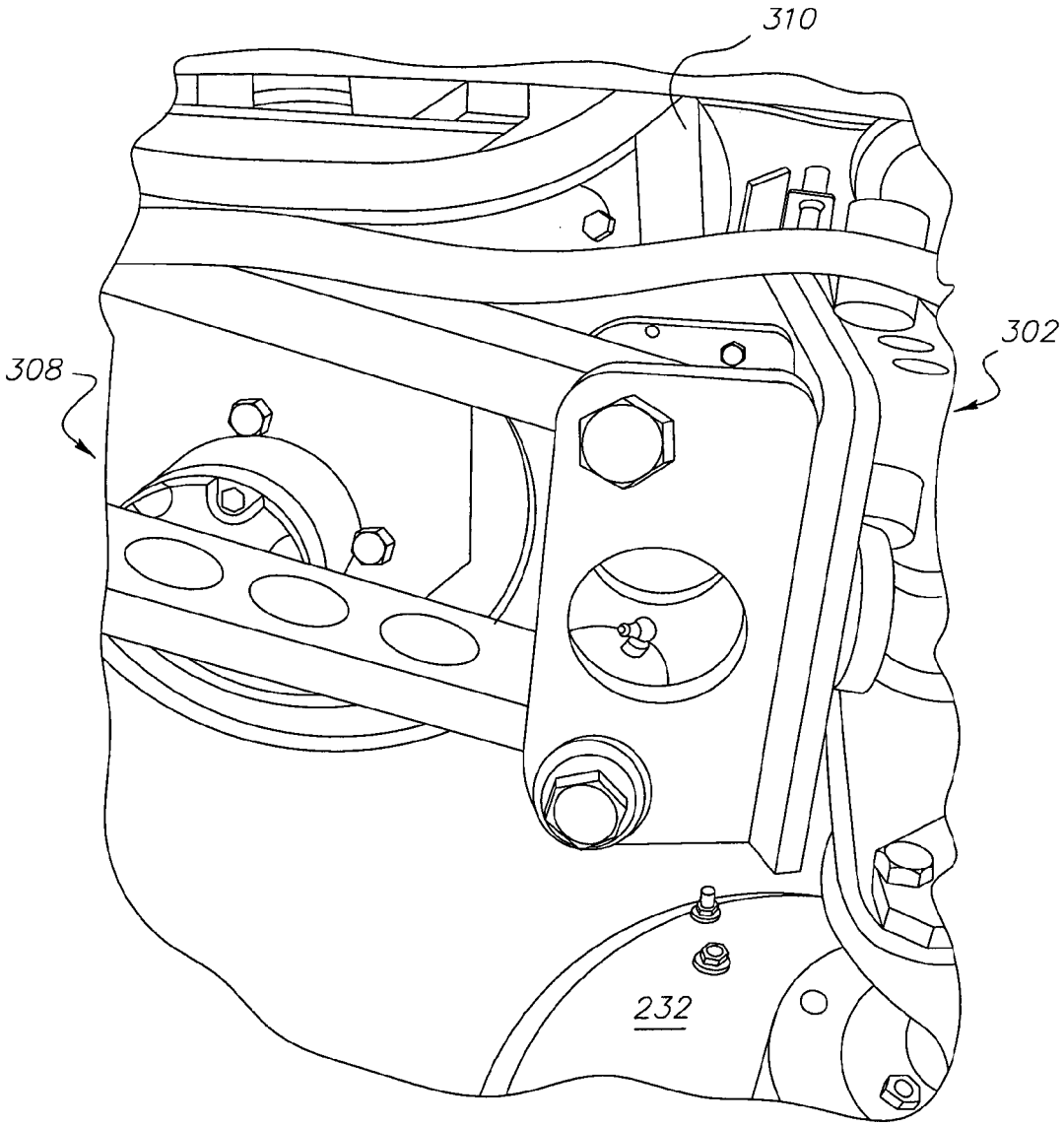
Figure 20:
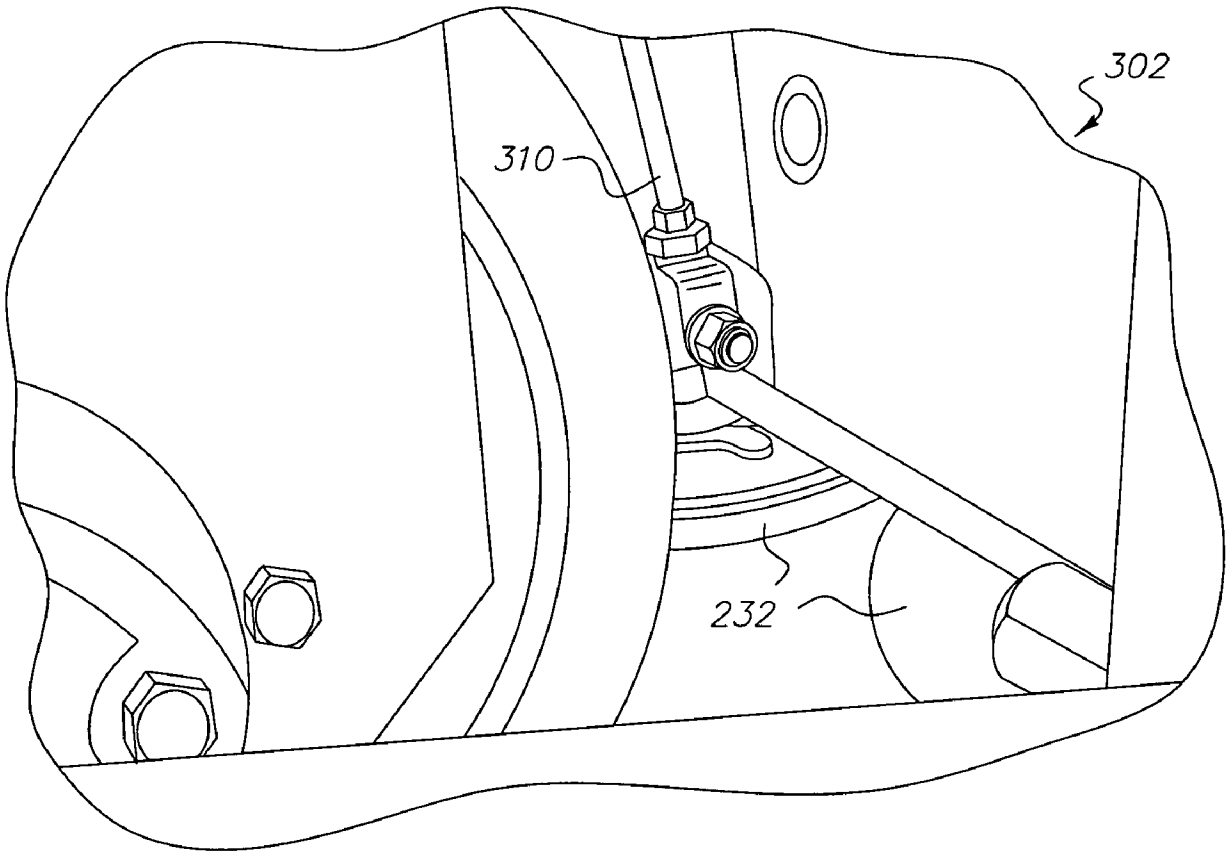

A mounting deck 302 is shown in FIG. 18. The deck 302 is mounted to the frame 304 by a central pivot 306, two stabilizing arms 308 (FIG. 19), and a lift arm 310 (FIGS. 19 and 20). The lift arm 310 is hydraulically actuated to raise and lower the deck 302 as well as provide the down pressure to the deck 302 that is distributed to the planetary heads 232. The lift arm 310 is centrally located behind the central pivot 306 to allow the deck 302 to pivot side to side about the central pivot 306 while still providing the down pressure. The ability of the deck 302 to pivot about the axis of the central pivot 306 ensures an even distribution of down pressure on the planetary heads 232 in situations that would otherwise cause an uneven down pressure. Such situations include turning the machine, variations in the surface being scrubbed or ground, and movement of the user that changes the distribution of weight over the deck 302. The deck 302 is also able to pivot in the transverse direction to the axis of the central pivot 306 by a pivot that locks the transverse angular position prior to use of the floor grinder/scrubber 200. Alternatively, the transverse pivot is free to allow the deck 302 to pivot front to back during use of the floor grinder/scrubber 200. In a further alternative, a knuckle that allows the deck 302 to pivot side to side and front to back replaces the central pivot 306 and the transverse pivot.

It should be noted that springs connecting each side of deck 302 to the frame 304 may be used to further stabilize the deck 302. The springs prevent the deck 302 from tipping to one side or the other when the deck 302 is in the raised position.

Figure 21:
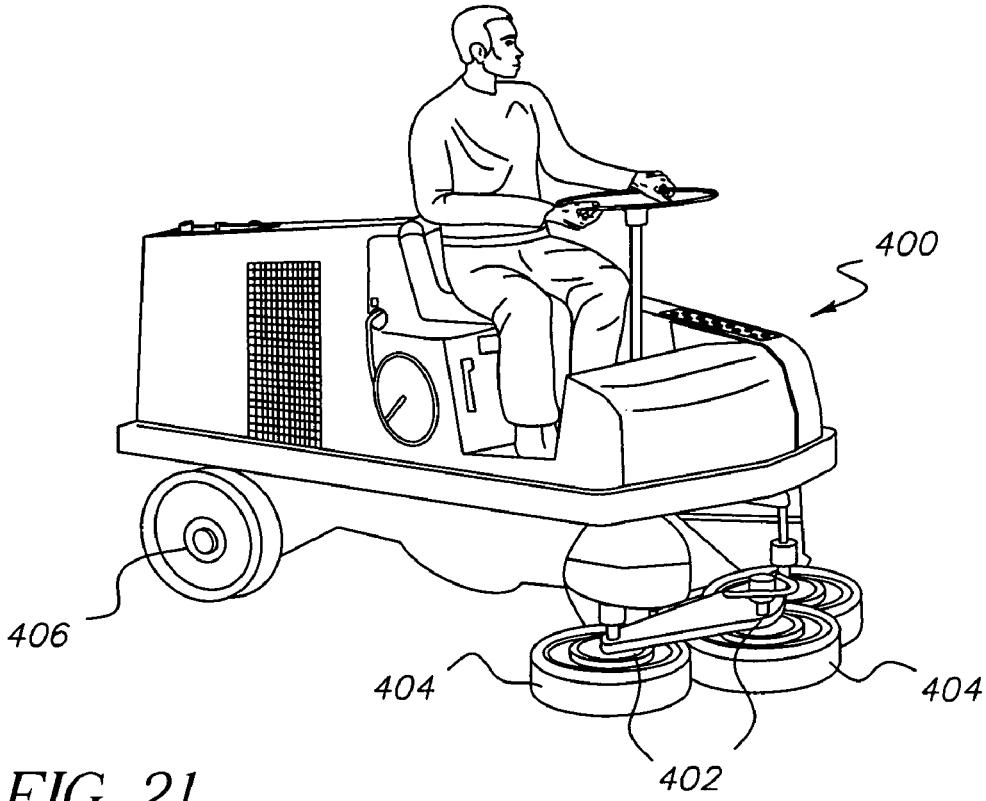
FIGS. 21-23 illustrate generally another embodiment of the invention.

In the embodiment shown in FIG. 21, grinder/scrubber 400 also uses the rapid changing planetary heads and drivers 402 previously described and by the positions of the grinder wheels or scrubber brushes 404 shown can provide a work surface of, e.g., 50 inches wide to work flush with walls. By the positioning of the various wheels as shown, the unit as illustrated is highly maneuverable by its ability to make a 180 degree turn in under 100 inches. A water cooled industrial LP, gasoline or diesel engine capable of operating at different precisely controlled speeds powers the grinder/scrubber 400, with variable speed motors to turn the wheels and brushes and the hydraulic pressures adjusted as appropriate for the surface being worked and the operation being performed. The rear squeegee 406 can be a curved gum rubber blade, and preferably about a 60 gallon fiberglass supply tank and about an 80 gallon fiberglass recovery tank for the solutions applied and the waste recovered. At this capacity, the unit is capable of covering up to about 96,000 square feet per hour of operation.

Figure 22:
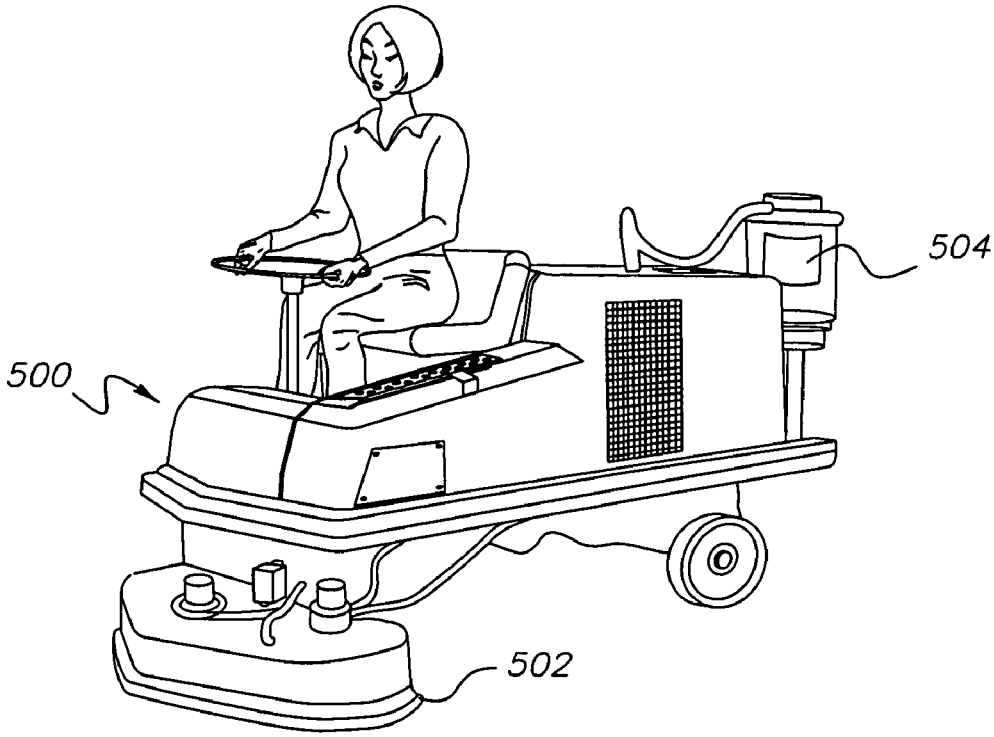

The grinder/scrubber 500 illustrated in FIG. 22 is similar to that in FIG. 21, except that it also is provided with a full flexible rubber skirt 502 surrounding the grinder/scrubber wheels and engaging the floor surface to contain the solution applied and to draw by a conventional vacuum means the spent solution and waste material to the rearwardly mounted recovery tank 504.

Figure 23:
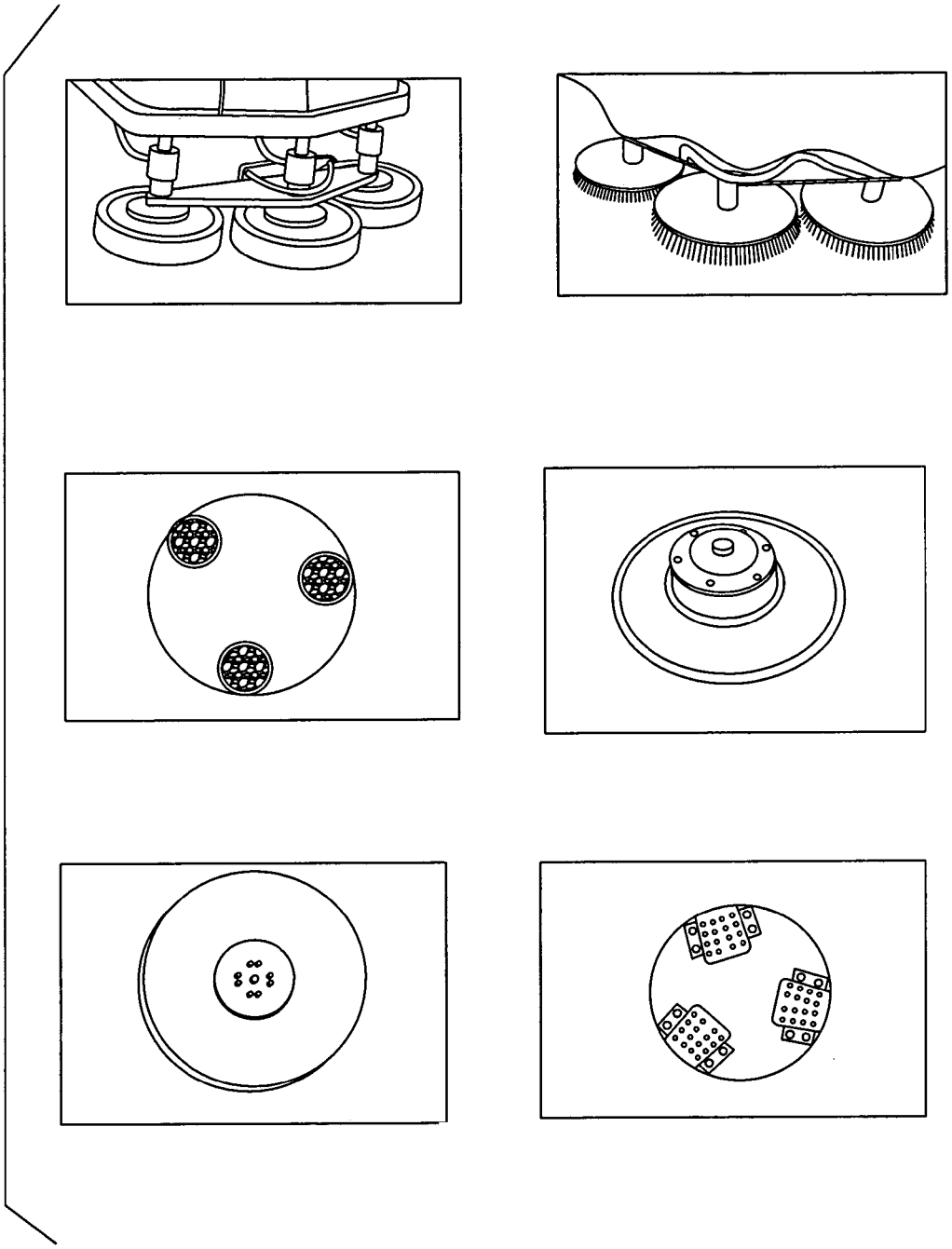

Further details of the drivers and wheels as used in the embodiments of FIGS. 21 and 22 may be seen in FIG. 23.

The invention claimed is:

1. A floor surface scrubbing and resurfacing apparatus, comprising:

a. a frame including a front and a rear, said frame having means for driving the apparatus;

b. a front wheel and two rear wheels attached to the frame and connected to the drive means, the front wheel being centrally located and turnable to maneuver the apparatus;

c. at least two drive mechanisms attached laterally to the frame and positioned in front of the front wheel;

d. at least two grinder/scrubber tools and quick coupling means for attaching and detaching the grinder/scrubber tools to the drive mechanisms;

e. hydraulic means for lifting and lowering the attached tools and for adjusting the separation of the drive mechanisms from each other;

f. means for applying grinding/scrubbing solution to a floor surface and means for collecting spent solution from the floor surface; and g. and a squeegee disposed rearward of the front wheel and attached to the frame to recover any spent solution not recovered by the collecting means.

2. The apparatus according to claim 1 in which the drive means is adjustable to vary the maneuvering speed of the apparatus.

3. The apparatus according to claim 1 wherein the hydraulic means is further configured to adjust the pressure at which the grinder/scrubber tools engage the floor surface.

4. The apparatus according to claim 1 including three drive mechanisms.

5. The apparatus according to claim 1 wherein the collecting means further comprises:

at least one skirt surrounding the grinder/scrubber tools and configured to contain spent solution;

a skirt-lifting mechanism attached to the at least one skirt;

a recovery tank; and vacuum means for drawing spent solution and any waste materials into the recovery tank.

6. The apparatus according to claim 4 including three grinder/scrubber tools.

7. The apparatus according to claim 1 wherein the collecting means further includes a squeegee lifting mechanism attached to the frame and configured to raise and lower the squeegee for engagement with a floor surface.

8. The apparatus according to claim 1 wherein the quick coupling means is selected from the group consisting of at least one drive knuckle, a plurality of hook and loop fasteners, and at least one Frankfurt shoe.

9. A floor surface scrubbing and resurfacing apparatus, comprising:

a. a frame having a front, a rear, a first side and a second side;

b. a front wheel attached to said frame, said front wheel being centrally located between the first side and the second side of said frame;

c. a first rear wheel attached to the first side of the rear of said frame;

d. a second rear wheel attached to the second side of the rear of said frame;

e. a first frontmost circular brush attached to the front of said frame near the first side of said frame, said first frontmost circular brush having a first frontmost brush lifting mechanism;

f. a second frontmost circular brush attached to the front of said frame near the second side of said frame, said second frontmost circular brush having a second frontmost brush lifting mechanism;

g. a rearmost circular brush attached to said frame behind said first frontmost circular brush and said second frontmost circular brush; said rearmost circular brush being centrally located between the first side and the second side of said frame and being closer to the front of said frame than said front wheel, said rearmost circular brush having a rearmost brush lifting mechanism;

h. a first skirt attached to the first side of said frame near the front of said frame, said first skirt being oriented to be substantially parallel to the first side of said frame, said first skirt having a first skirt lifting mechanism;

i. a second skirt attached to the second side of said frame near the front of said frame, said second skirt being oriented to be substantially parallel to the second side of said frame said second skirt having a second skirt lifting mechanism; and j. a rear squeegee attached to said frame directly to the rear of said front wheel and being centrally located between the first side and the second side of said frame, said rear squeegee having a squeegee lifting mechanism.

10. The floor surface scrubbing and resurfacing apparatus of claim 1 further including a mounting deck connected to the frame such that the mounting deck may pivot about at least one axis, the mounting deck having a raised position and a lowered position, the mounting deck being configured to engage the at least one grinder/scrubber tool such that the at least one grinder/scrubber tool engages a floor surface when the mounting deck is in the lowered position.

* * * * *

UNITED STATES PATENT AND TRADEMARK OFFICE

CERTIFICATE OF CORRECTION

PATENT NO. : 7,640,622 B2
APPLICATION NO. : 11/111114
DATED : January 5, 2010
INVENTOR(S) : Raymond E. Vankouwenberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1240 days.

Signed and Sealed this

Twenty-first Day of December, 2010

David J. Kappos

David J. Kappos
*Director of the United States Patent and Trademark Office*